US009584897B2

(12) United States Patent
Ushakov

(10) Patent No.: US 9,584,897 B2
(45) Date of Patent: Feb. 28, 2017

(54) IN-THE-EAR EARPHONE, ITS VARIATIONS AND METHODS OF WEARING THE EARPHONE

(71) Applicant: Alexey Leonidovich Ushakov, Moscow (RU)

(72) Inventor: Alexey Leonidovich Ushakov, Moscow (RU)

( * ) Notice: Subject to any disclaimer, the term of this patent is extended or adjusted under 35 U.S.C. 154(b) by 0 days.

(21) Appl. No.: 14/632,459

(22) Filed: Feb. 26, 2015

(65) Prior Publication Data

US 2016/0050477 A1 Feb. 18, 2016

(30) Foreign Application Priority Data

Aug. 15, 2014 (RU) ..... 2014133659

(51) Int. Cl.
*H04R 25/00* (2006.01)
*H04R 1/10* (2006.01)

(52) U.S. Cl.
CPC ..... *H04R 1/105* (2013.01); *H04R 1/1016* (2013.01)

(58) Field of Classification Search
CPC ... H04R 1/105; H04R 1/1066; H04R 2225/63
See application file for complete search history.

(56) References Cited

U.S. PATENT DOCUMENTS 5,881,161 A * 3/1999 Liu ..... H04R 1/1066 381/370
6,047,076 A * 4/2000 Yang ..... H04R 1/1066 181/129
8,103,040 B2 * 1/2012 Pelland ..... H04R 1/1041 381/374
8,116,502 B2 * 2/2012 Saggio, Jr. ..... H04R 1/1016 381/328
8,194,911 B2 * 6/2012 Dyer ..... H04R 1/1016 181/135
2012/0116231 A1 * 5/2012 Liao ..... H04R 1/105 600/473

* cited by examiner

*Primary Examiner* — Curtis Kuntz
*Assistant Examiner* — Ryan Robinson
(74) *Attorney, Agent, or Firm* — Bardmesser Law Group

(57) ABSTRACT

An adjustable in-ear earphone can be worn in two positions. The earphone includes an acoustic part comprising an electroacoustic transducer and a sound opening for outputting sound from the transducer, a wire, electrically connected with the transducer, a mechanical part, connected with the acoustic part through a cylindrical hinge and having a rotatable shaft, a resilient element, connected to one end of the shaft, a guide wire connected to the opposite end of the shaft. The resilient member and the guide are located at a larger end of the acoustic part in the same plane with the axis of rotation of the shaft and oriented substantially in opposite directions from the axis of rotation of the shaft. The sound opening is located at the other end of the acoustic part. The cylindrical hinge permits rotation of the shaft by 70+ degrees.

54 Claims, 23 Drawing Sheets

IN-THE-EAR EARPHONE, ITS VARIATIONS AND METHODS OF WEARING THE EARPHONE

FIELD OF THE INVENTION

The present invention relates to the field of acoustics, in particular to earphones, and more particularly to adjustable in-ear earphones.

BACKGROUND OF THE RELATED ART

Earphones placed inside the ear, according to the type of embodiment are divided into two types:

earbuds or plug-in earphones;

in-ear-canalphones or IEMs (In-Ear-Monitors).

Earbuds (inserted)—earphones are inserted into the ear and held there by the resilience force. Earphones of this type do not completely plug the external auditory canal and are placed next to it, directing the sound waves in the direction of the external auditory canal. The disadvantages of this type of earphone may include:

poor sound insulation from ambient noise;

due to the fact that they do not completely cover the external auditory canal, audio quality is significantly degraded;

weakly bound inside the ear if not provided with additional devices to hold it in place.

But earbuds have certain advantages: they do not irritate the pressure-sensitive surface of the membranous-cartilaginous (front) of the external auditory canal and allow hearing surrounding sounds.

In-ear-canalphones (in various sources, also called vacuum earphones, plugs, ear monitors, in English sources as IEMs)—are worn completely plug the ear canal, providing good insulation against ambient noise.

Compared with earbuds they have a number of tangible advantages:

provide high-quality sound;

in-ear-canalphones—IEM stay in the ear relatively well, since they quite tightly and deeply enter into the external auditory canal.

The disadvantages of this type of earphones include:

unpleasant and painful sensations during long-term wear, since they strongly pressure on the most sensitive area of the outer ear—the front part of the membranous-cartilaginous portion of the external auditory canal;

ear opening is earphone-plugged, and consequently, it is difficult to outflow from the sebaceous and sulfur glands located in the membranous-cartilaginous portion of the external auditory canal;

due to the relatively good passive noise-isolation, hearing of ambient sounds is difficult;

increases the load on the hearing aid during prolonged listening at high volume levels that can cause hearing loss.

In some constructive solutions, earbuds are supplied with directed-into-the ear canal pin with soft sealing ear cushion. This increases the useful volume of the earphones through the use of internal volume of the ear, not just the ear canal. However, such earphones have all the disadvantages of in-ear-canalphones.

A known custom headset for placement in the ear (US Application Publication No. 2011/0135120 A1), consists of a housing containing a near and remote part, where a remote part has a built-in speaker, and is formed for accommodation in the ear canal of the user. Also, a remote part includes a projection for its seal in the ear canal. This headset has no moving parts, and thus does not give an opportunity to adjust the earpiece in the ear of the user, and does not combine the features of in-ear-canalphones and earbuds.

A known earphone (U.S. Pat. No. 8,265,328) consists of an ear hook, a shaft attached to the end of the ear hook, a housing for an electro-acoustic transducer, a tube allowing the body to move along the shaft, and also includes a cable connected to the electroacoustic transducer and extending inside the ear hook, shaft and housing. This earphone design allows for a minor adjustment of the position of the earphone inside the ear, but only earbuds can be used. Despite the fact that the sliding of the shaft is provided in the tube attached to the earpiece, movement is only possible in the longitudinal axis direction, without rotation. This earphone is rather cumbersome and hook-shaped, which may lead to the engagement of the clothes or wire during an inoperative state. It complicates the use of the earphones in conjunction with other equipment, such as goggles, helmets etc.

A known ear loop for earphone (U.S. Pat. No. 8,320,603) like the previously considered earphones, has a shaft inserted in the ear hook tube that enables adjustment of the earphone inside the ear. This design has the same disadvantages as the previous earphone, and is itself a plug-in with some characteristics of a particular type of earphone, which excludes its transformation into an intra-canal earphone.

A known earphone adapter (U.S. Pat. No. 8,472,660) is intended for earbuds. It comprises a BTE (Behind The Ear) earhook with the option of movable placement of earphone on it, allowing adjustment of earphone. The disadvantages of this adapter is the fact that only earbuds can be used, since the mobility of the earphone on the earhook axis doesn't allow placement of the earphone in an intra-cannel position, i.e., to transform earphone from the earbud into in-ear-canalphones. In addition, when wearing the earhook covers the ear from the outside almost completely, due to which the entire structure is large and has a pronounced hook shape. This adapter has the inherent disadvantages of the two previously considered devices.

A known earbud type of earphone having auricular fastening (U.S. Pat. No. 5,729,615) has the rod rigidly attached to the earphone acoustic elements, where the rod enters into the bushing, a continuation of which is a BTE earhook of earphone. The acoustic element can be rotated relative to the bushing-earhook and vertically lifted or lowered by sliding the rod inside the bushing. The disadvantage is a limited number of adjustments intended for selecting only one relatively comfortable position with the acoustic element in the auricle when using earphones for different people with different anthropometric data. Moreover, an integral fixture of this type of earphone is a massive BTE earhook, increasing the size, complicating form and increasing the number of clinging hook-shaped members in the earphone.

A known a device of the earphones with a stabilizer (U.S. Pat. No. 8,374,375) comprises a housing and a flexible member to stabilize the earphone when wearing it by abutting the wall of the ear. The flexible element has two stable positions relative to the housing and respectively earphone can have two positions in the auricle. But in this device change in position of earphone in the ear does not lead to the possibility of its transformation from earbud into in-ear-canalphones.

A known acoustic device with the adaptation for placement in a human ear (U.S. Pat. No. 7,068,803) is an earphone with a spring in the form of a flexible rod, which holds the earphone in the ear of the user, located in a bent state along the wall of the ear. This device provides secure fit of the earphone in the auricle in the only possible position, not allowing adjustment of the earphone or its transformation.

A known hearing aid with a flexible elongate member (U.S. Pat. No. 8,374,367) is made in the form of earbuds, containing a microphone, processor, headset, battery and a flexible elongated portion, one end of which is attached to the housing, and the other is free. When the flexible elongate portion is placed in the user is auricle, the free end is located inside the auricle and outside the ear canal. As with the previous device, a hearing aid is retained in the auricle due to the resilience of the elongated member that enables to secure the unit in the only position.

A known retaining element for micro-earphone for use in hearing aids (U.S. Pat. No. 7,590,255) has in-ear-canalphones provided with elongate resilient member for support on the internal parts of the auricle, where the aggregate resilience of the tissues of the auricle and the elongate member promotes fixation of the earbud in the ear canal, preventing its loss during wear. This element is designed only for hearing aids and also provides for the use of earphone in a simple position, eliminating the possibility of transformation earphone from in-ear-canalphones into earbuds.

A known universal hearing aid (U.S. Pat. No. 7,899,200) also comprises an elongated resilient part to fix the earphone in the user auricle. This unit has the inherent disadvantages of the two previously considered devices.

The general disadvantage of most of the considered earphone devices can also be attributed use of design solutions with ear cushions made of soft material (rubber, foam, rubber foam) for adaptation and fitting of earphone in the ear canal of the user. But soft materials become easily contaminated with dust or earwax, are poorly cleanable and therefore can easily become unhygienic.

Thus, to date there are no in the ear earphones that allow full use of the benefits of design solutions for earbuds and in-ear-canalphones—IEM (In Ear Monitor), depending on current requirements of the user when worn.

Justification of the Proposed Structural Embodiment of Earphones.

When wearing earbuds, a user may experience some difficulties when they are loosely inserted into the auditory canal, as earphones spontaneously fall out of the ear. Some manufacturers try to solve this by placing on the earpiece extra soft and flexible stops (soft springs), abutting against the antihelix or lower leg of the antihelix. In order that the devices not irritate or pressure sensitive parts of the ear, it is required to select the least sensitive parts of the ear which will be pressured by resilient elements of the earphone and distribute the pressure over a larger area. As an example, consider two options of chuckles of the glasses—the so-called "children's" glasses with semi-rounded spring temples resiliently covering the conchae from outside and the rear. This option is present in cheaper models of glasses, and long wearing often causes discomfort, as the conchae is very sensitive in these points of contact with temples, on the inside or on the outside (although with short-term use, discomfort could not be even noticed). Expensive glasses are held with minimal discomfort without squeezing the ear only because temples resiliently semi-cover the human skull, as places of semi-coverage on the skull having much less tactile sensitivity.

When designing earphones for permanent (long-term) use, structure, innervation and blood supply to the concha of human ear should be considered, so as not to cause long-term irritation and oppressive effects on the most sensitive areas of the ear.

Blood supply to the ear is carried out through the posterior auricular artery, the superficial temporal artery and branches of the internal maxillary artery. Blood from the auricle enters the superficial temporal and posterior auricular veins that usually go along with the arteries.

Innervation of the auricle is carried out by a great auricular nerve, small occipital nerve, trigeminal nerve, nerve endings mixed branches of the vagus, glossopharyngeal and facial nerves.

Thus, a detailed study of schematics of nerves and blood vessels with a high degree of probability, the least sensitive to prolonged tactile mechanical stress is a portion the auricle at the junction of the ear cavity to the back side of anti-tragus. It is in the lower part of the ear cavity where the main body weight of the earphone should be placed in the auricle with a negligible impact on the tragus—lower part of the antihelix (front-back), and the inside of the anti-tragus—ear cavity (laterally).

The second support point (from which comes out the earphone wire) may be the edge of the temporal bone, slightly above and over the tragus hump, already outside the auricle. This place is the least sensitive because it is no longer the auricle, here there is an extensive insensitive connective tissue zone—ligamentum auriculare anterius (ligament of the auricle front), and all the nerves and arteries pass under this ligament, and, therefore, the surface of the ligamentum auriculare anterius is insensitive to the prolonged pressure.

Accordingly, a solution to these problems is desired.

SUMMARY OF INVENTION

The object of the present invention to provide earphones having advantages of earbuds and simultaneously in-ear-canalphones, but without the drawbacks inherent to each type, that is, the earphones should be securely kept in-ear during wear, but their position could be changed, that is, the earphones must have two fixed positions; the first position—intra-channel, the second position—in the auricle, without taking the entire ear canal and allowing the user to hear surrounding sounds. Such earphones allow, depending on the environment and requirements of the user, provide passive noise reduction or to control the sound environment around user.

The problem is solved by creating an in-ear earphone to be worn in two positions, containing an acoustic portion, which includes at least one electroacoustic transducer and at least one sound opening for the acoustic output signal. Also the earphone comprises a wire electrically connected to the electroacoustic transducer, a mechanical part connected to the acoustic part through the cylindrical hinge and having a rotatable shaft, a resilient member connected to one end of the shaft, a guide wire connected to an opposite end of the shaft. The resilient member and the guide are located at its larger part in the same plane with the axis of the rotation of the shaft and oriented substantially in opposite directions from the axis of rotation of the shaft. The sound opening is located at the end of the acoustic part, opposing cylindrical hinge, the end portion of acoustic part is designed to exclude the possibility of clogging the sound opening when wearing in any of the positions. The cylindrical hinge is designed to permit rotation of the shaft by an angle $\alpha$, which is at least 70 degrees from the position wherein the guide is oriented towards the sound opening. The wire is mechanically connected with the guide.

Preferably, that the guide had a length such that when worn in any of these two the guide is housed in the upper clipping of the auricle between the leg curl and upper-tragus tubercle, while a place of connection of the wires and the guide is located on a surface of the front ligaments of the auricle, and the wire rounds the ear at the top. The acoustic part, when worn in one of the two positions, corresponding to rotation of the shaft at an angle $\alpha$=70-90 degrees, the acoustic part at least partially is housed inside the outer auditory canal of the user, where the sound opening is deepened into the external auditory canal, a resilient member located within the cavity of the auricle behind the anti-tragus, and thus may serve to extract the earphone of the external auditory canal. The acoustic part, when wearing the earphone in the other the position corresponding to the orientation of the guide towards the sound opening, is located in the cavity of the auricle between the tragus and anti-tragus, sound opening located in the vicinity of the entrance of the external auditory canal, and the resilient element abuts the lower leg of the antihelix and thus serves to keep the headset in the ear.

The earphone further comprises a protective grille, designed to protect from clogging the sound opening.

At least one end of the shaft is curved relative to the axis of rotation of the shaft.

Both ends of the shaft are curved in opposite directions from the axis of rotation of the shaft.

The earphone further comprises a return mechanism that returns the shaft to a position wherein the guide is oriented towards the sound opening, and the angle $\alpha$ is close to or equal to 0.

The return mechanism can be a cylindrical helical spring freely wound around the shaft. One end of the spring is attached to the acoustic part and the other end of the spring is attached to the one the ends of the shaft.

The return mechanism can be a bending spring, one end of which is attached to one end of the shaft and the other end is attached to the acoustic part of the earphone.

Preferably, that the cylindrical hinge further comprises at least one sleeve, in which is located the shaft.

The mechanical part is pivotable of the shaft by an angle $\alpha$ in the range of 70 to 90 degrees in any direction from the position where the guide is oriented in the direction of the sound opening.

The earphone can be worn in either ear of the user.

The wire at the section between the fastening places of the wire to the guide and to the acoustic transducer has additional slack to allow rotation of the shaft.

The shaft and the resilient member are made hollow, the wire is placed inside the shaft and the elastic member and further is mechanically fastened to the lower end of the shaft, forming a loop, and the portion of wire between places of additional fastening of wires to the lower end of the shaft and to the electroacoustic transducer had an extra slack.

The wire further comprises an electrical connector on the section between the fastening places to the upper part of the shaft and to the acoustic transducer.

Preferably, the shaft is adapted for longitudinal movement within the cylindrical hinge. Also, the earpiece comprises a cylindrical helical compression spring, wound around the shaft between the guide and acoustic part.

A portion of the wire disposed between the guide and acoustic part can be a cylindrical helical compression spring wounded around the shaft.

The guide and the shaft are hollow, the wire is located inside the cavity, and a cylindrical hinge further comprises a brush-commutator assembly, adapted for electrical connection of the wires with the electroacoustic transducer.

The headset further comprises a embouchure, and the acoustic part is additionally equipped with mounts for it.

The earphone further comprises a soft case designed to fit over the acoustic part of the earphone, where the cover has at least one opening, serving for audio output and located opposite the sound opening when wearing the cover.

Preferably, the resilient element is removable.

The resilient member further comprises a longitudinal rigid thread secured inside the resilient member.

The resilient element is adapted to adjust its length.

The resilient element can be formed as a loop.

The earphone further comprises at least one retainer adapted to hold the shaft in at least one of the positions.

The earphone further comprises at least one microphone.

The earphone further comprises a bone conduction microphone.

Also, the objective is solved by creating an in-earphone to be worn in two positions, containing the acoustic part comprising at least one acoustic transducer and at least one sound opening, designed to output an acoustic signal generated by the electroacoustic transducer. An earphone wire is electrically connected to the electroacoustic transducer, a mechanical part connected to the acoustic part through the cylindrical hinge and comprising a rotatable shaft. A resilient member is connected to one end of the shaft. A guide wire, is coupled to an opposite end of the shaft, where the resilient member and the guide having its large part in one plane with the axis of shaft rotation, and are oriented essentially in opposite directions from the axis of shaft rotation. The sound opening is located at the end of acoustic part, opposing cylindrical hinge, the end of acoustic part configured so as to prevent clogging of the sound opening when wearing the earphone in any of the positions. The cylindrical hinge when allows rotation of the shaft by an angle $\alpha$, which is at least 70 degrees from a position when the guide is oriented towards the sound opening. The wire is mechanically connected to the guide The guide has a length such that when worn in any of these two positions, the guide is placed at the top of the auricle clipping between leg curl and upper-tragus tubercle, and the place of connection wire and the guide located on a surface of the front ligament of the auricle, and the wire goes around the ear from the top. The acoustic part is shaped so that when worn in one of the two positions corresponding to the shaft rotation at an angle $\alpha$ = 70–90 degrees, the acoustic part is at least partially housed within the user's outer auditory canal. The sound outlet is recessed into the external auditory canal, a resilient member located in the cavity of the auricle behind anti-tragus and thus can serve to extract the earphone from the external auditory canal. The acoustic part, when the user wears the headset in the other above-mentioned position, corresponding to orientation of the guide in the direction of the sound opening, is located in the cavity of the auricle between the tragus and anti-tragus, the sound outlet is located at the same time in the vicinity of the entrance of the external auditory canal, and the resilient element abuts the lower leg of antihelix and thus serves to keep the earpiece in ear.

The earphone further comprises a protective grille, designed for protection against clogging of the sound outlet when worn.

At least one end of the shaft has been executed curved with respect to the axis of rotation of the shaft.

Both ends of the shaft can be curved in opposite directions from the axis of rotation of shaft.

The earphone further comprises a return mechanism which returns the shaft to a position wherein the guide is oriented towards the sound opening, and the angle α is close to or equal to 0.

The return mechanism is configured as a helical cylindrical spring loosely wound around the shaft, wherein one end of the spring is attached to the acoustic part and the other end of the spring is attached to one end of the shaft.

The return mechanism can be a bending spring, one end of which is attached to one end of the shaft and the other end is attached to the acoustic part of the earphone.

The earphone further comprises at least one retainer adapted to hold the shaft, at least in one of the positions.

The mechanical part is pivotable on the shaft at the angle α in the range of 70 to 90 degrees in any direction from a position in which the guide is directed toward the sound opening.

The earphone can be worn any user's ear.

The wire in the area between the place of wire attachment to the guide and to the acoustic transducer has additional slack to allow rotation of the shaft.

The shaft and a resilient member are hollow, the wire is placed inside the shaft and the resilient member, and is further mechanically fastened to the lower end of the shaft, forming a loop, and the portion of wire between places of additional fastening of wire to the lower end of the shaft and to the electroacoustic transducer has an extra slack.

The wire further comprises an electrical connector on the section between places of attachment to the upper part of the shaft and to the acoustic transducer.

The shaft can move longitudinally in the cylindrical hinge.

The earphone further comprises a cylindrical helical compression spring wound around the shaft between the guide and the acoustic part.

A portion of the wire situated between the guide and acoustic part can be formed as a cylindrical helical compression spring wound around the shaft.

The guide and the shaft can be made hollow, the wire is located inside the cavities, where cylindrical hinge further comprises brush-collecting assembly adapted to be electrically connected to the wire with the electroacoustic transducer.

The earphone further comprises a embouchure, and the acoustic part is additionally equipped with its mounts.

The earphone further comprises a soft case designed to fit over the acoustic part of the earphone, where the case has at least one opening for the sound outlet and located opposite the sound opening when wearing the case.

Preferably, the resilient element is removable.

The resilient element further comprises a longitudinal rigid thread secured inside the resilient member.

The resilient element is adapted to adjust its length.

The resilient element was formed as a loop.

The cylindrical hinge further comprises at least one sleeve.

The earphone further comprises at least one microphone.

The earphone further comprises a bone conduction microphone.

Also, the objective is solved by providing a method of wearing the in-ear-canalphones comprising an acoustic part having at least one electro-acoustic transducer and at least one sound opening for the acoustic signal output, generated by electro-acoustic transducer also a headset comprises a wire electrically coupled to the electro-acoustic transducer, a mechanical portion connected to the acoustic part through a cylindrical hinge and comprising a rotatable shaft, a resilient member connected to one end of the shaft, a guide wire connected to an opposite end of the shaft, wherein, the resilient member and the guide located at its large parts in one plane with the axis of rotation of shaft, and oriented essentially in opposite directions from the axis of rotation of shaft, wherein the sound opening is located at the end of acoustic part, opposing to cylindrical hinge, the end of acoustic part configured so as to prevent clogging of the sound outlet during wearing in any of the positions, the cylindrical hinge is formed so as to allow rotation of the shaft by an angle α, which is at least 70 degrees from a position wherein the guide is oriented towards the sound opening, and the wire is mechanically connected to the guide, wherein, for arranging the sound opening inside of the external auditory canal, the user turns the shaft at an angle α, which is at least 70 degrees from a position wherein the guide is oriented towards the sound opening, arranges acoustic part inside of the external auditory openings, wherein a user places the resilient member in the cavity of the auricle behind anti-tragus, as for arranging the sound opening on the outside from the entrance of the external auditory canal, a user rotates the shaft to a position where the upper part of the shaft directed towards the acoustical opening, arranges acoustic part in the cavity of the auricle between the tragus and anti-tragus, a resilient member in the in the cavity of the auricle behind the anti-tragus, wherein, when worn in any of the two positions, the user places the guide wire at the top clipping of the ear auricle between the leg curl and the upper-tragus tubercle, place of connection of wire and the guide on the surface of the front ligament of the auricle, and wire from the top of the auricle.

BRIEF DESCRIPTION OF THE ATTACHED DRAWINGS

The invention is further explained by description of preferred embodiments with reference to the accompanying drawings, in which.

Figure 5A:
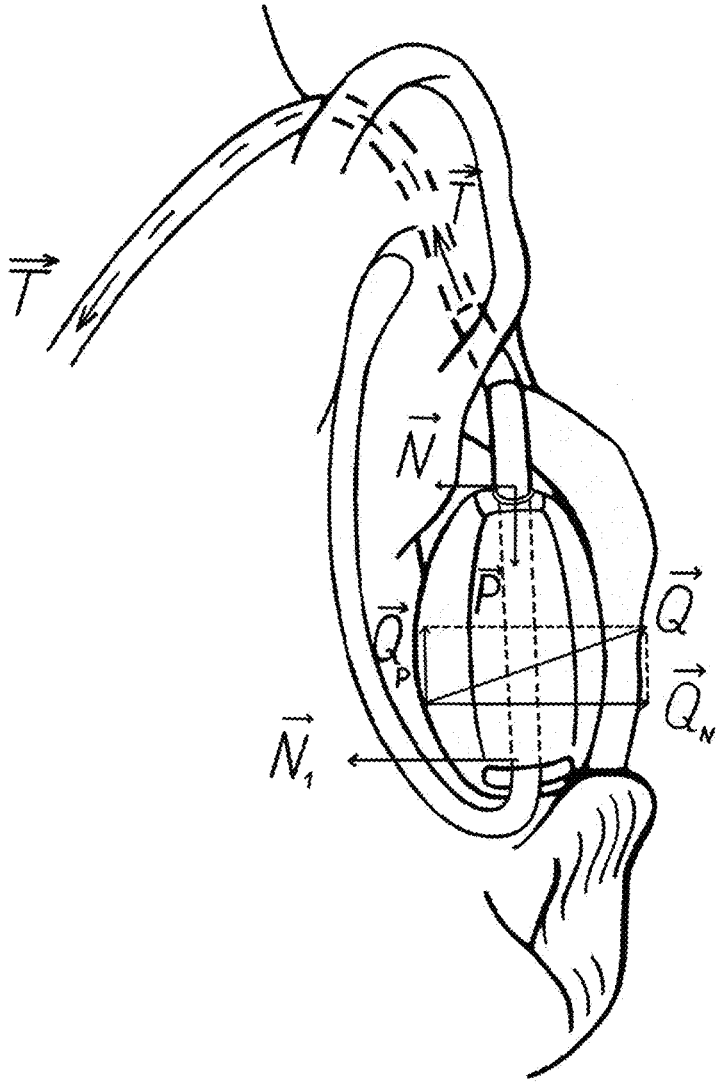
Figure 5B:
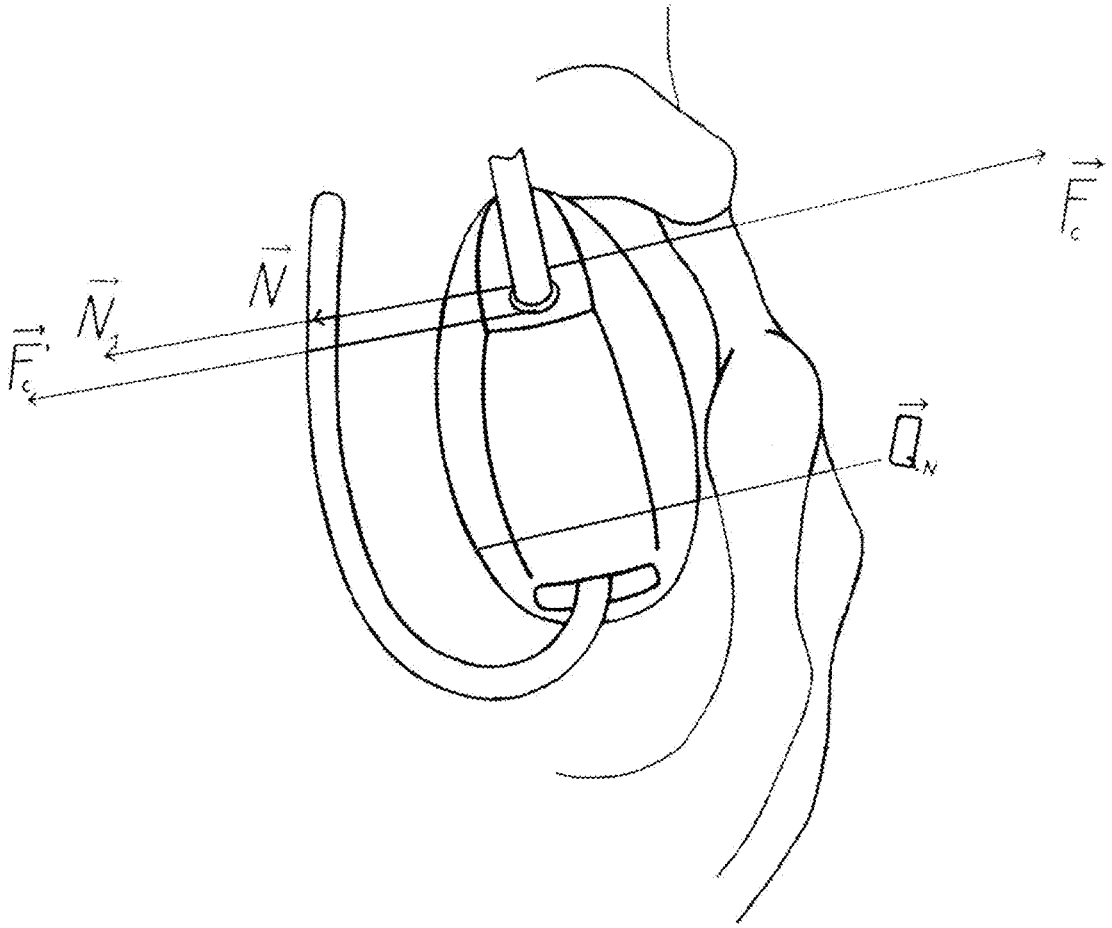
Figure 6:
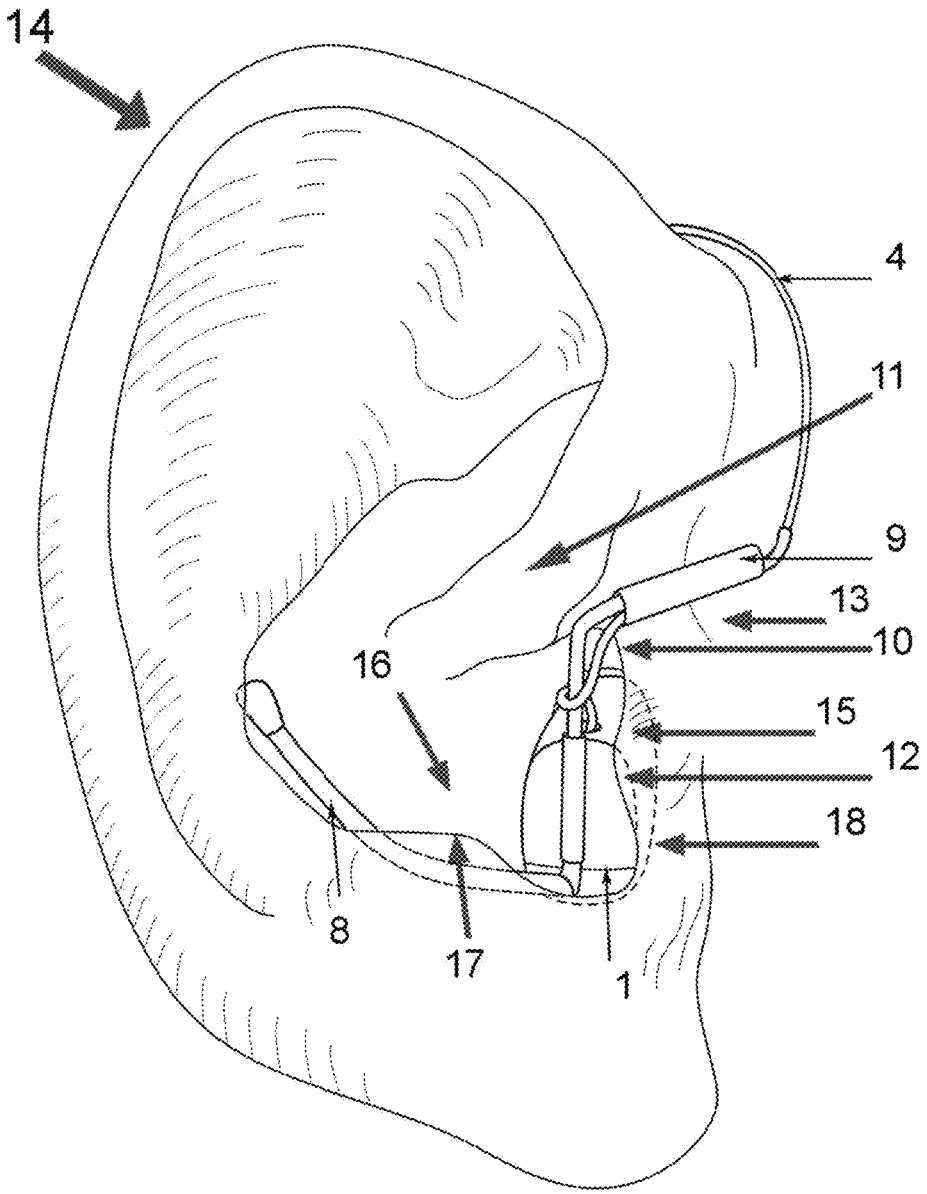
Figure 7:
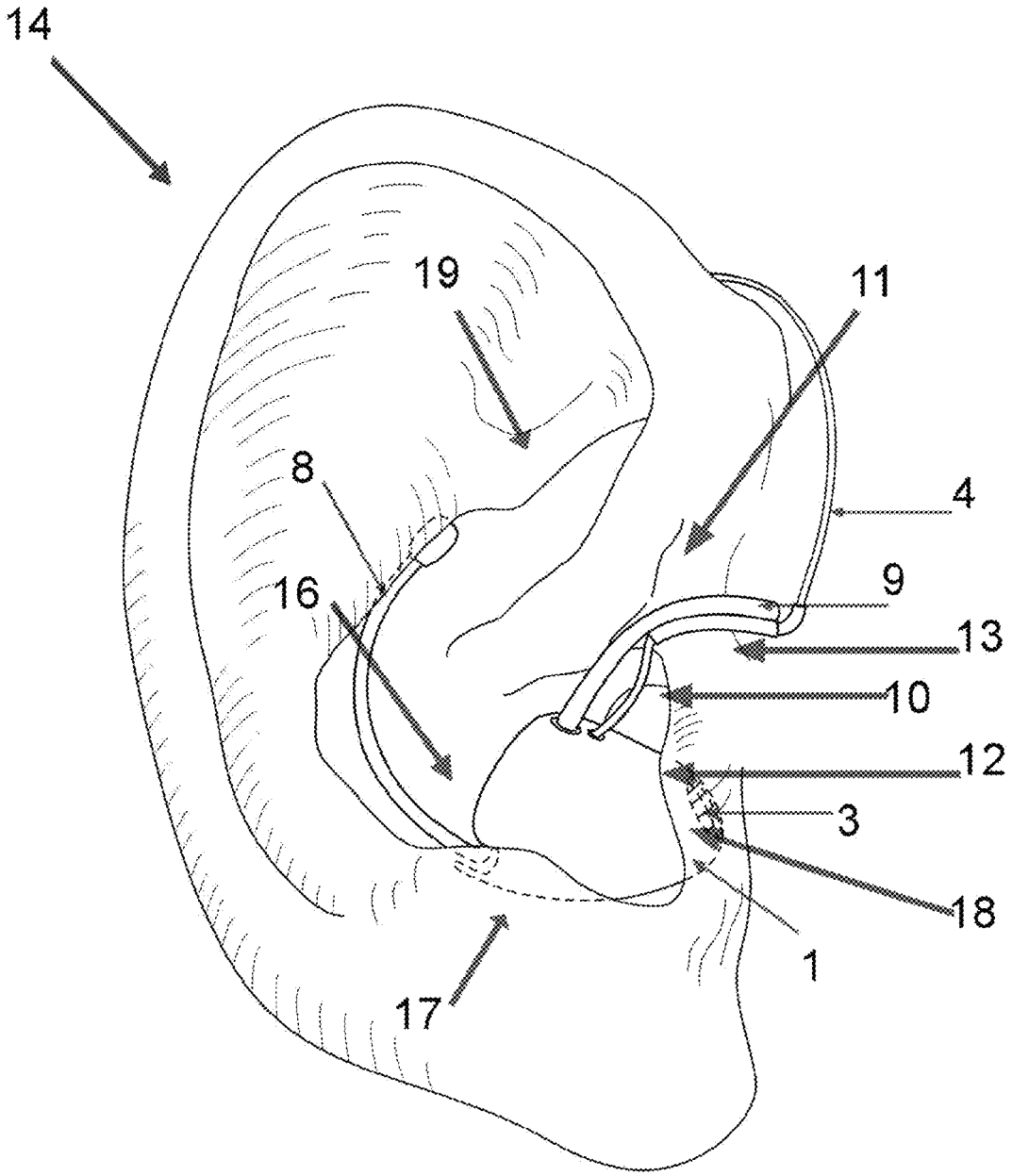
Figure 8:
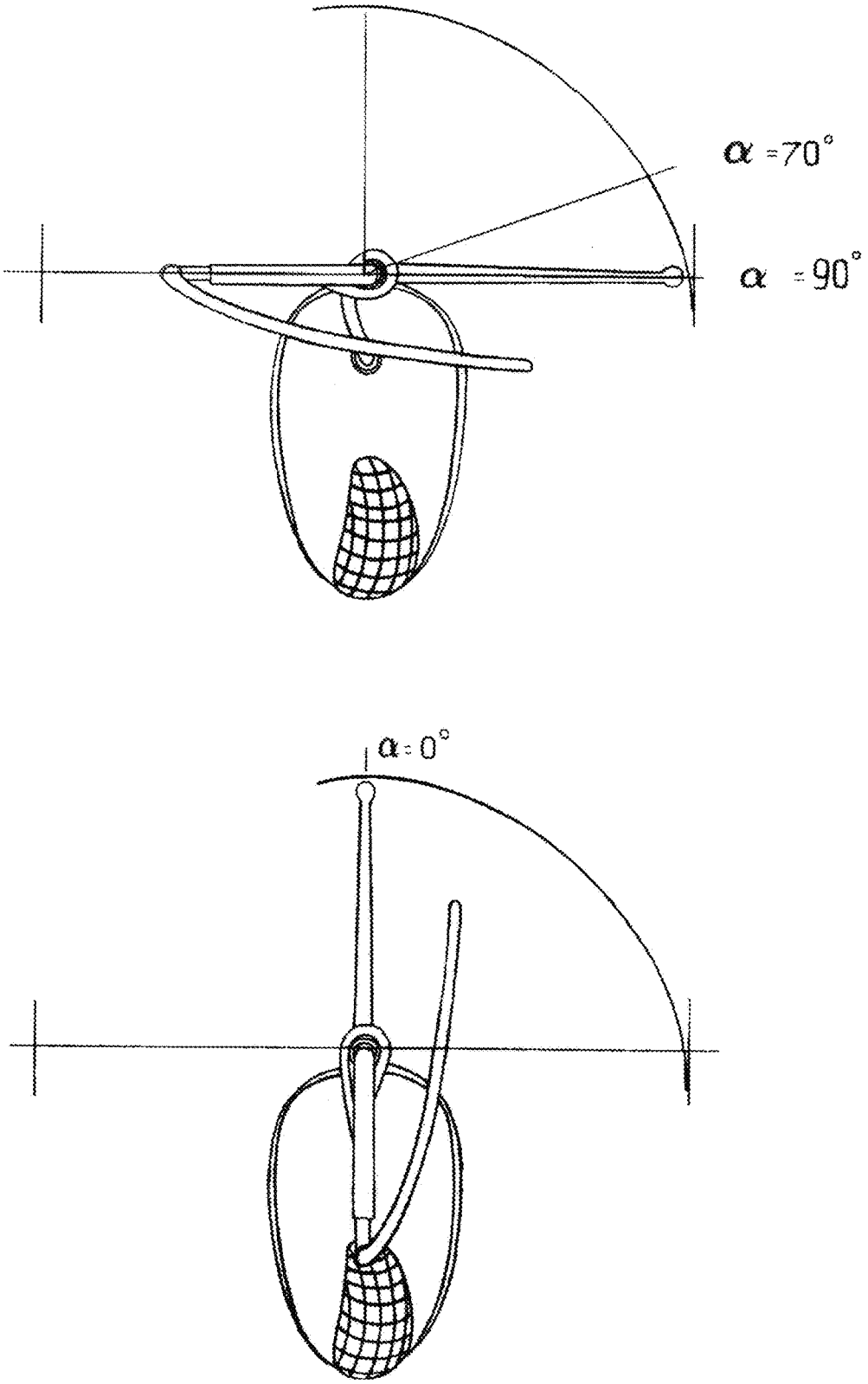
Figure 9:
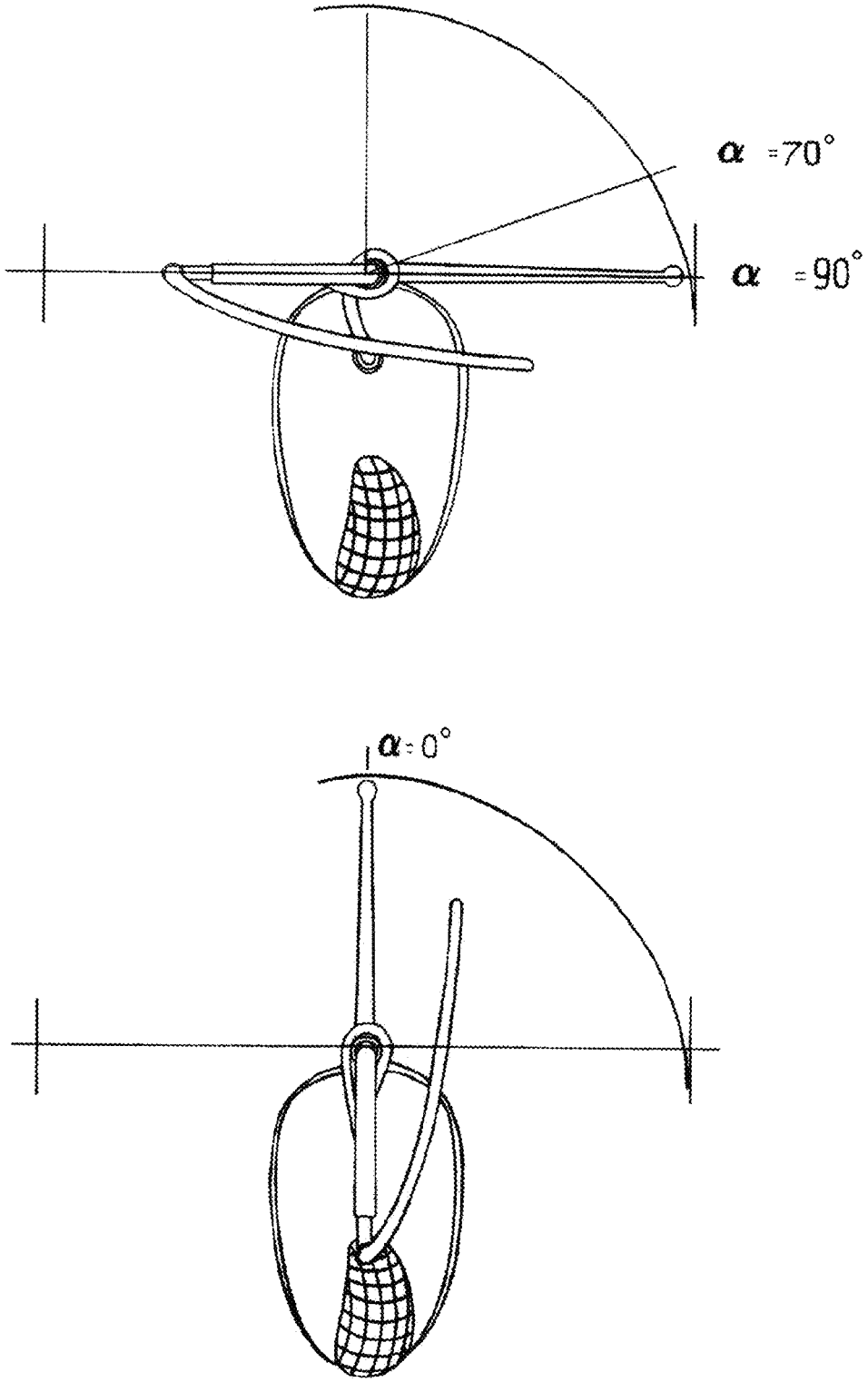
Figure 11:
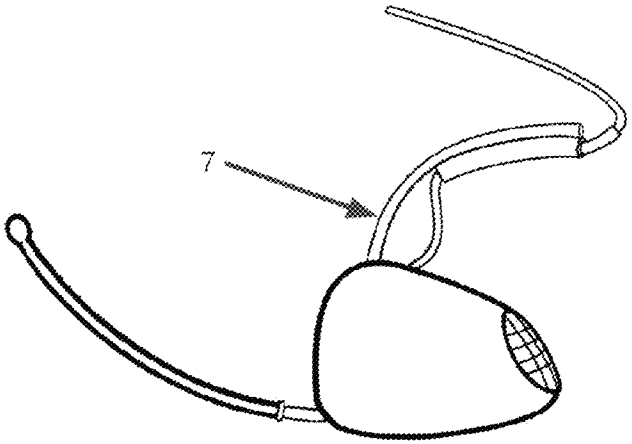
Figure 10:
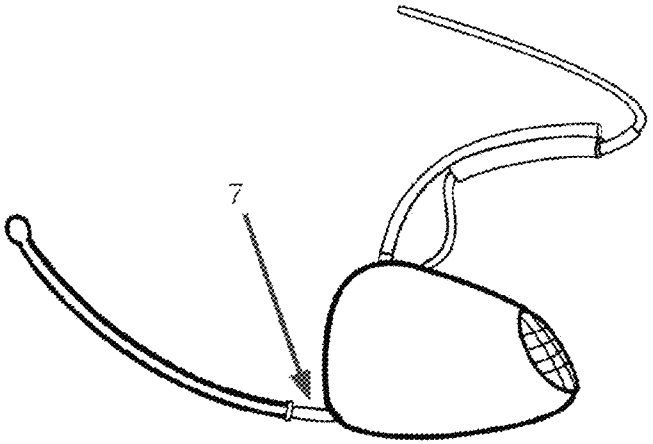
Figure 12:
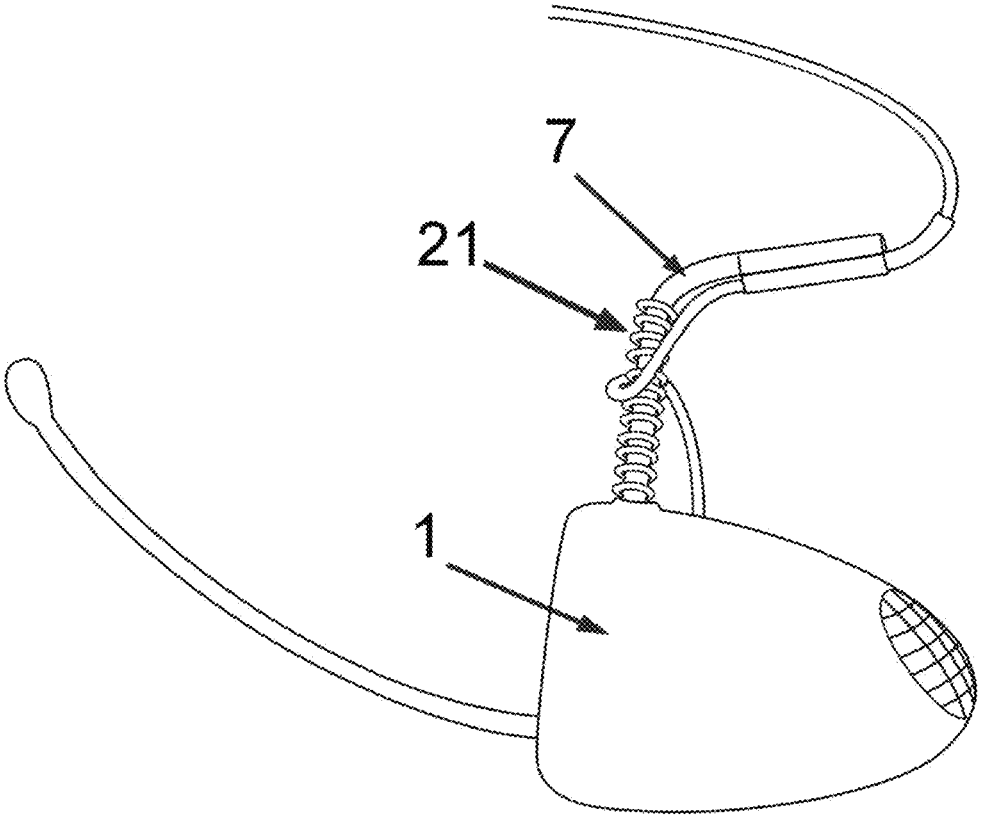
Figure 13:
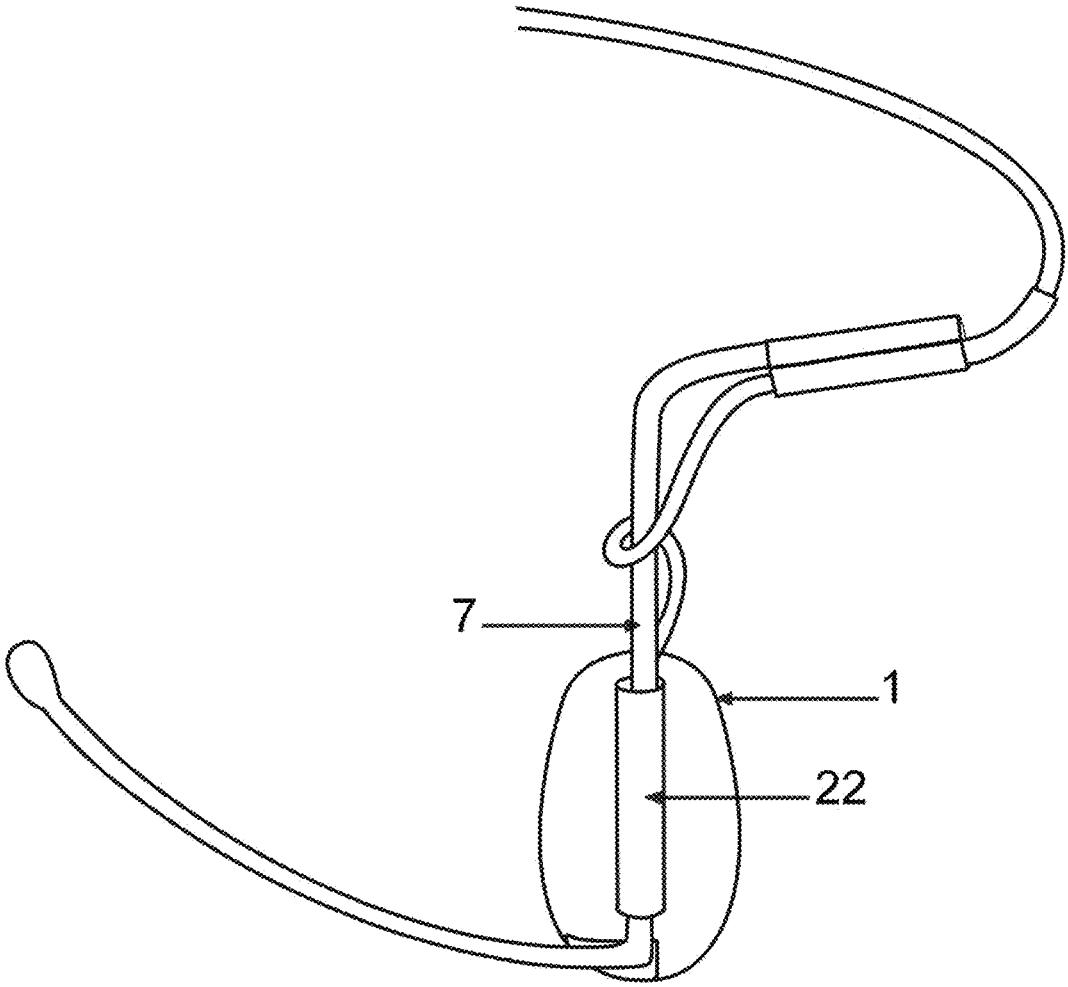
Figure 15:
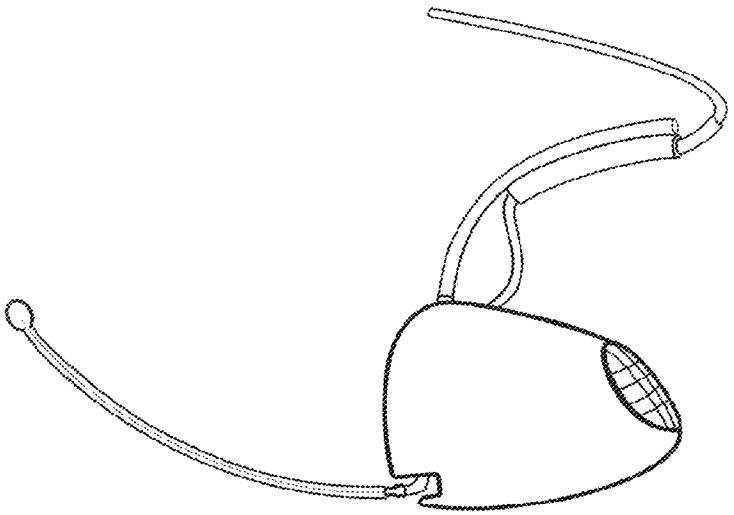
Figure 14:
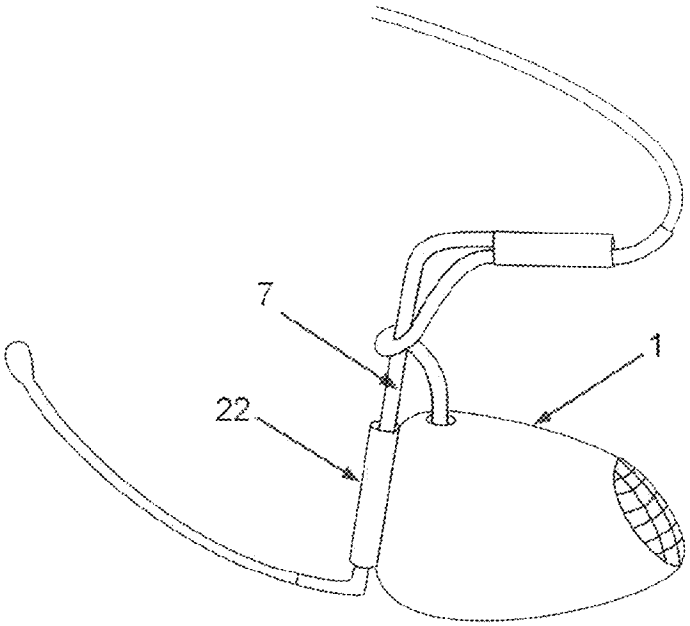
Figure 16:
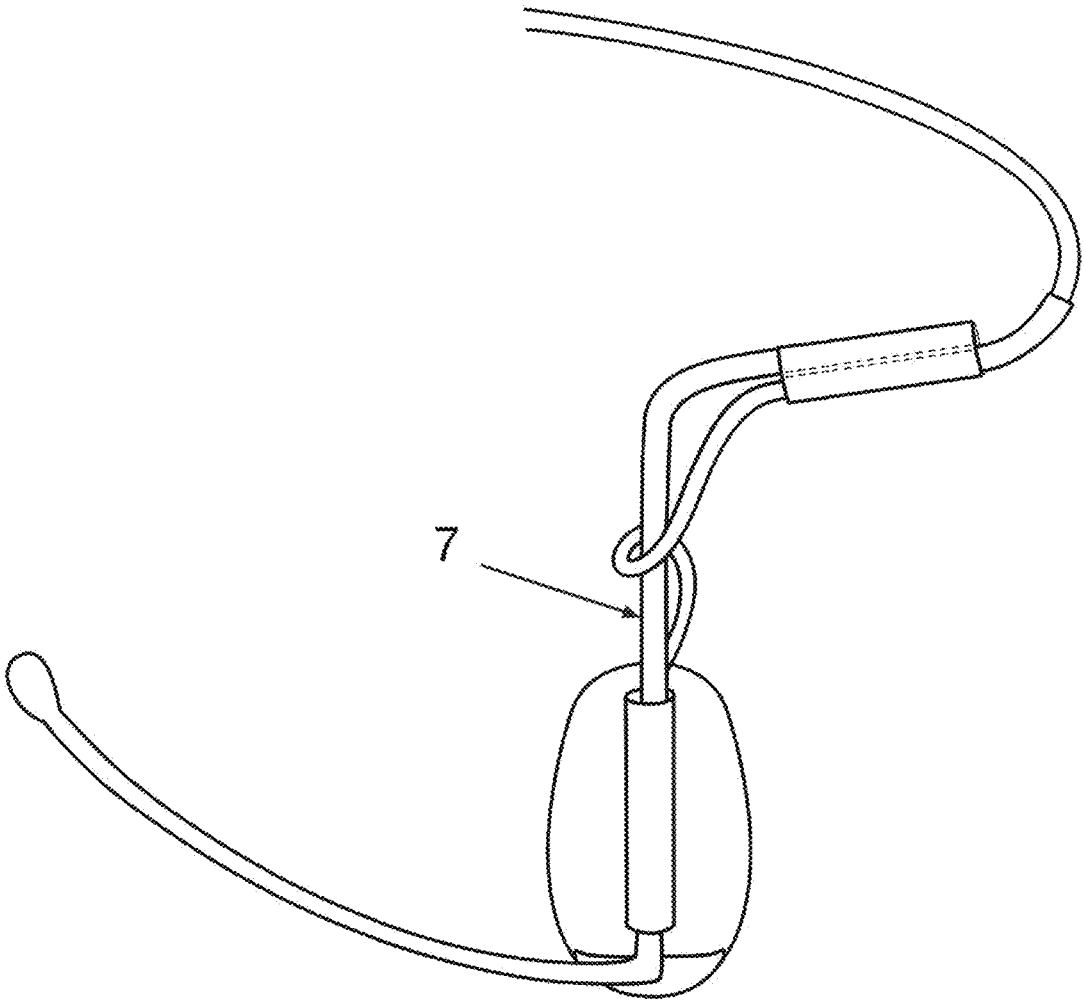
Figure 18:
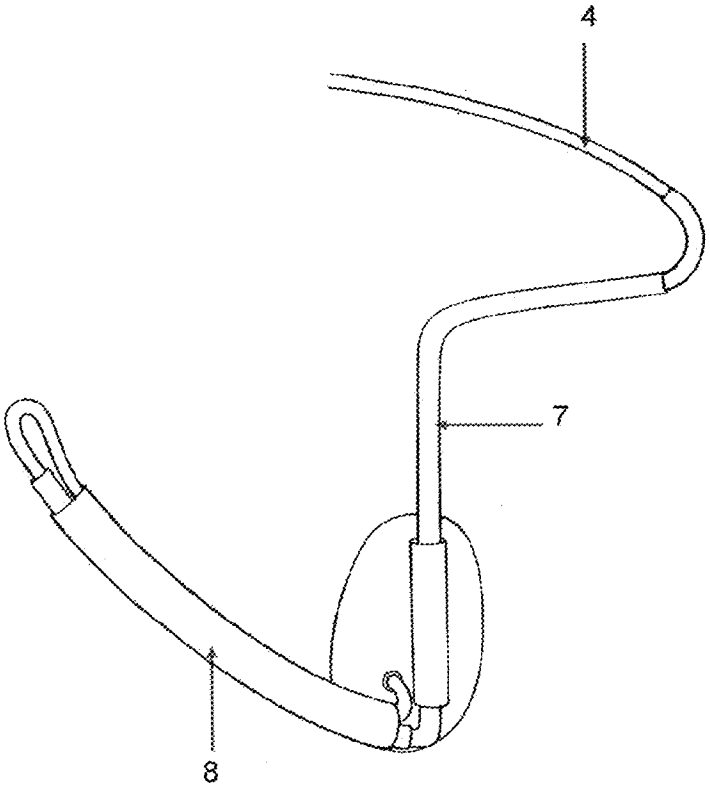
Figure 17:
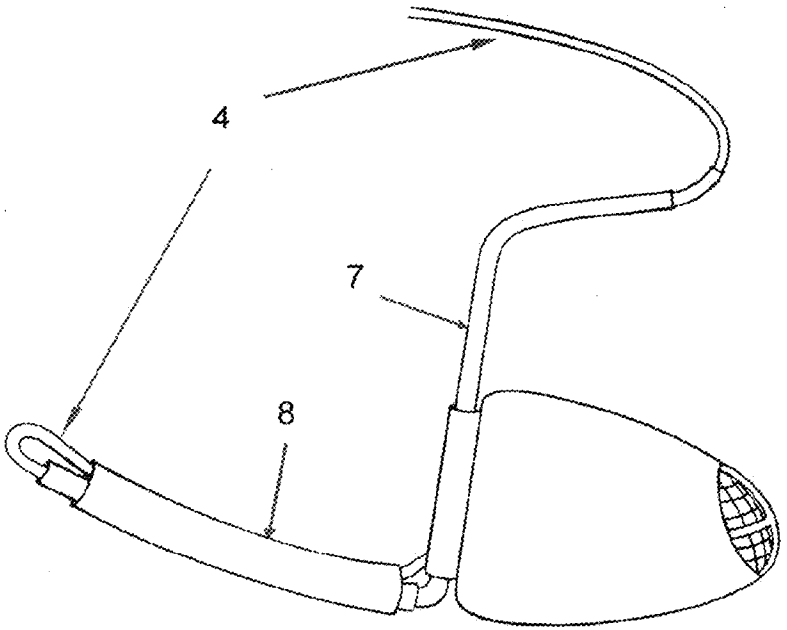
Figure 19:
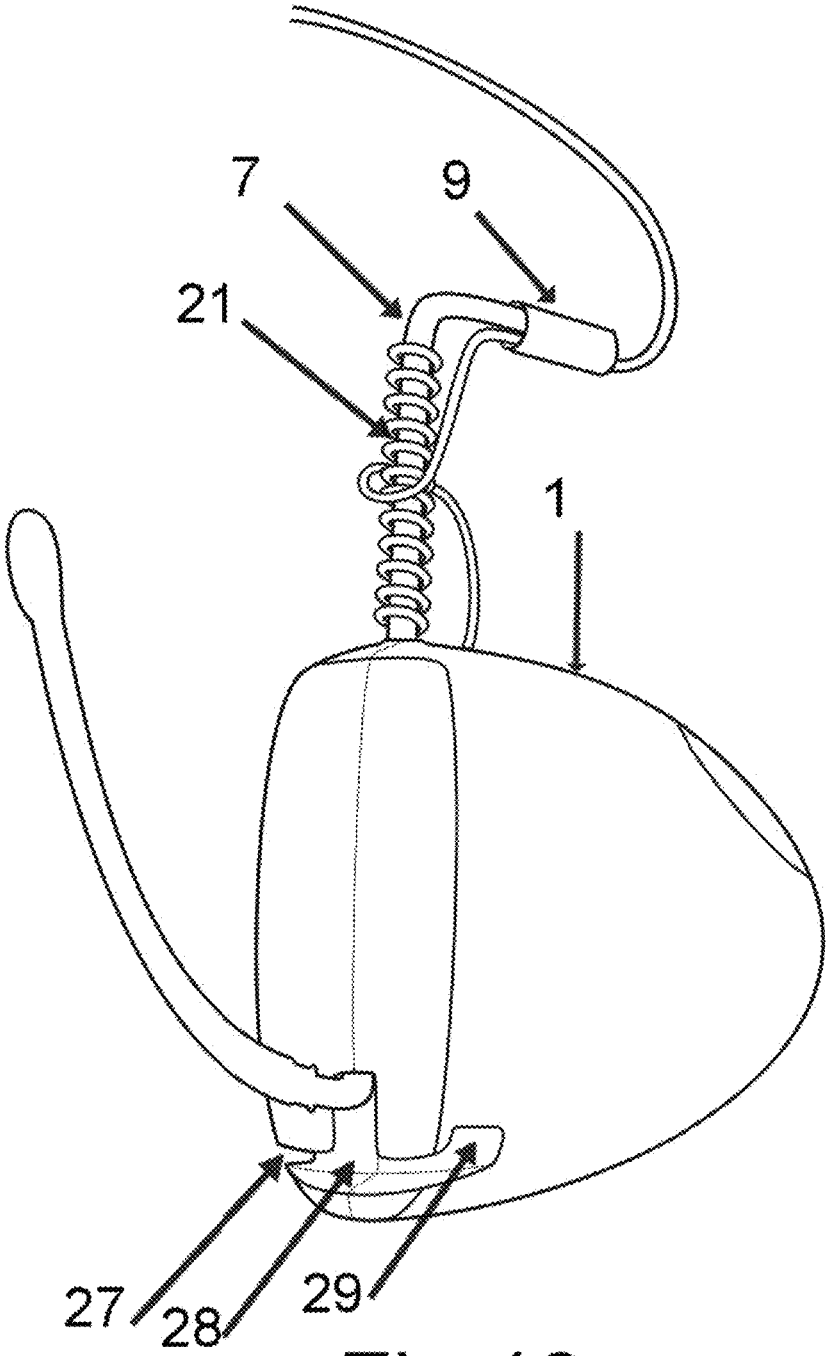
Figure 21:
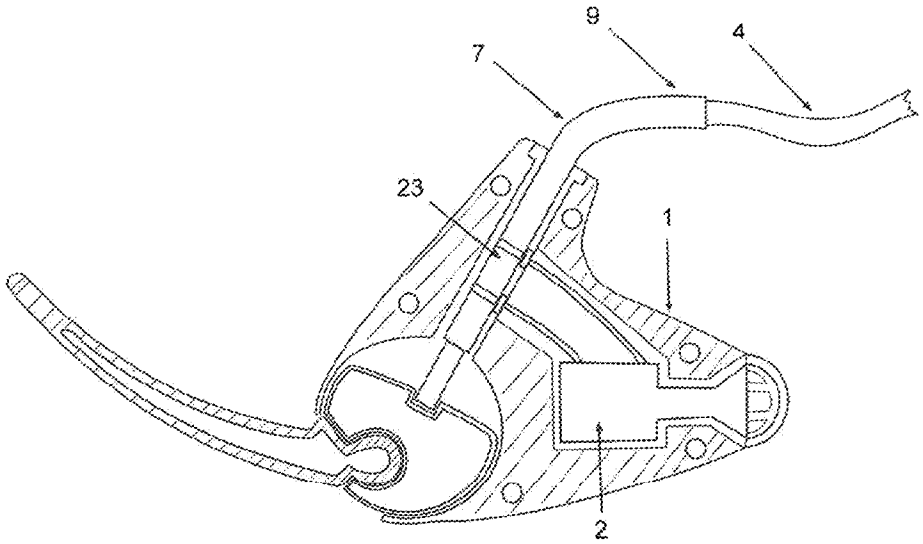
Figure 20:
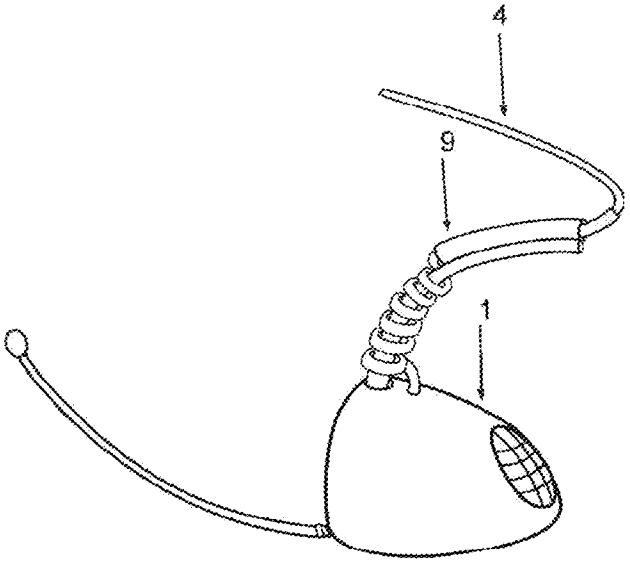
Figure 22:
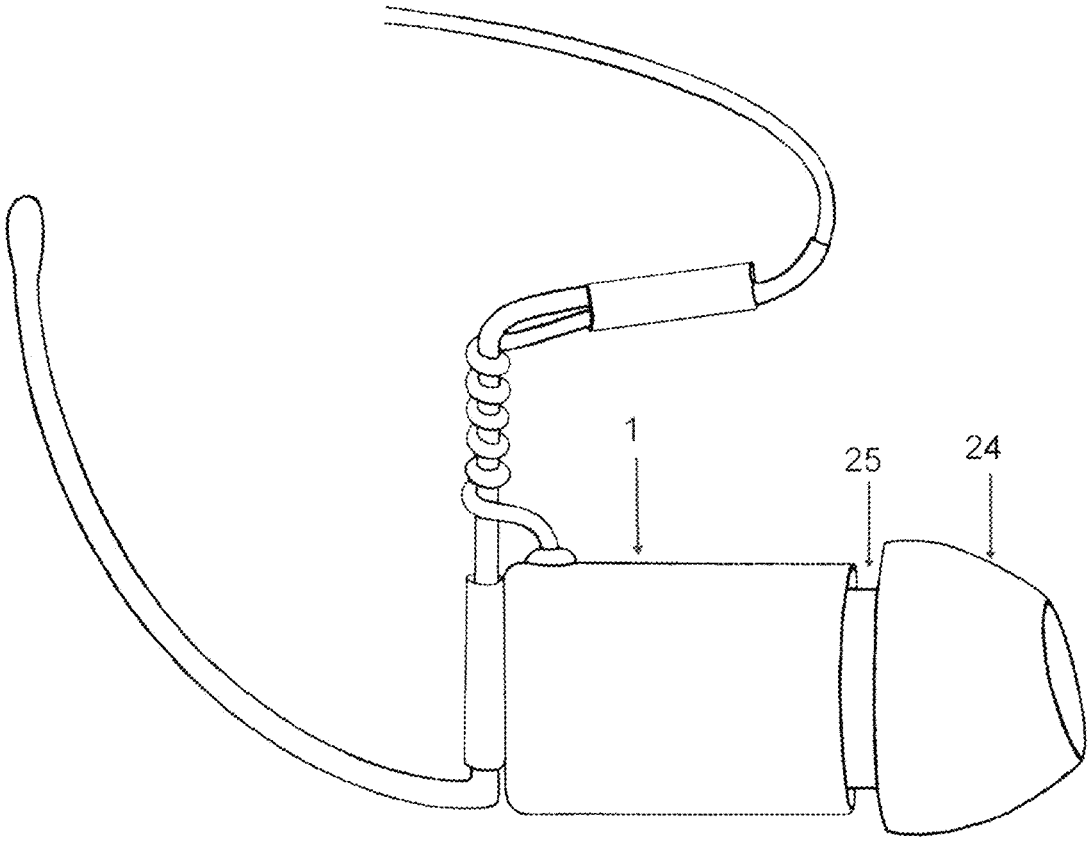
Figure 24:
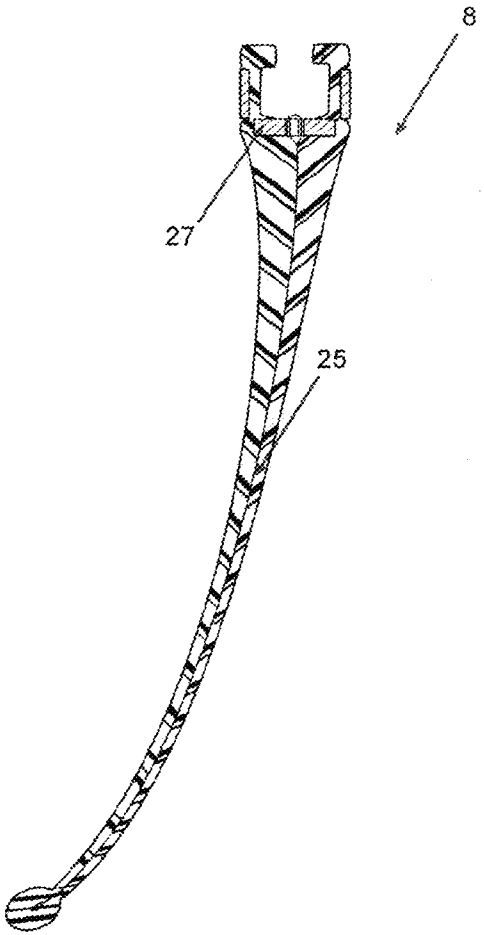
Figure 23:
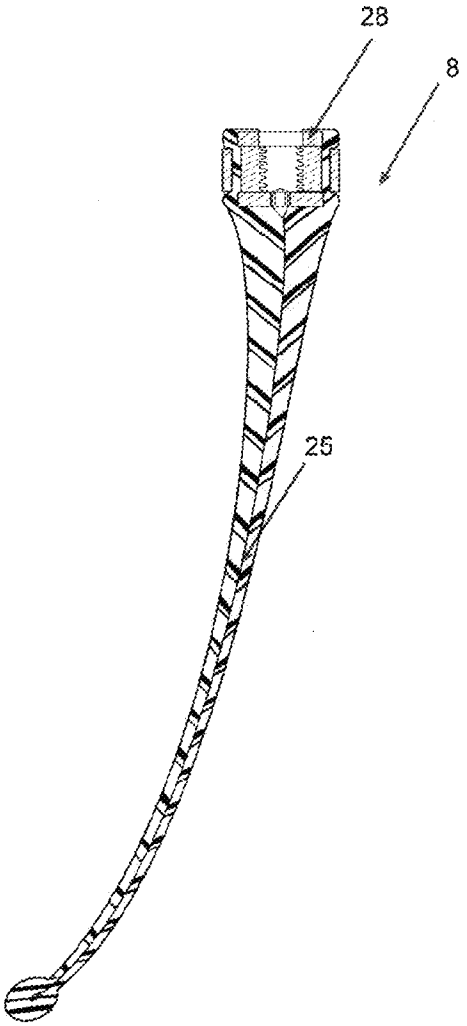
Figure 25:
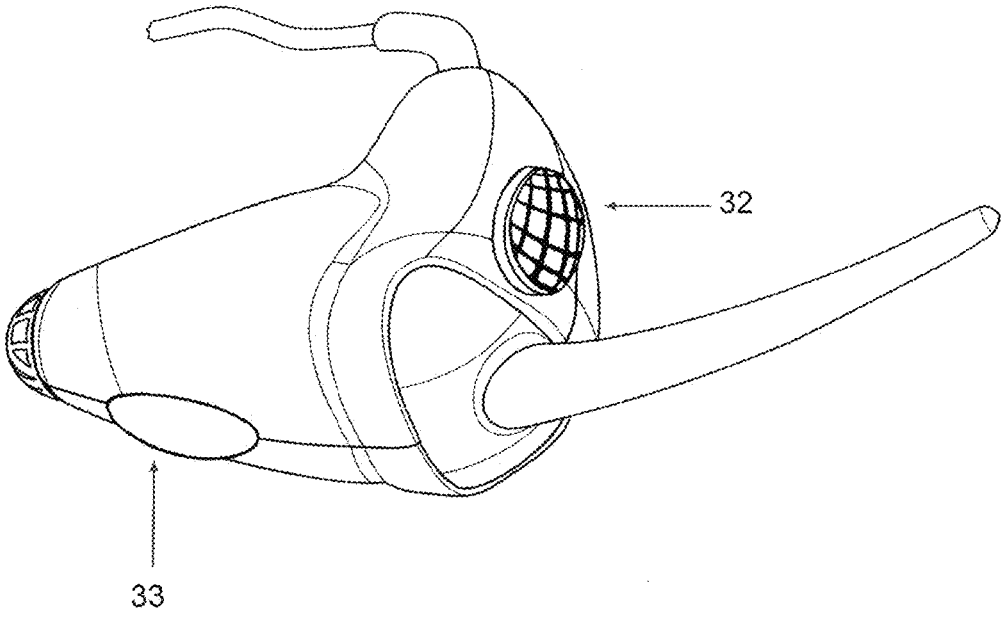
Figure 26:
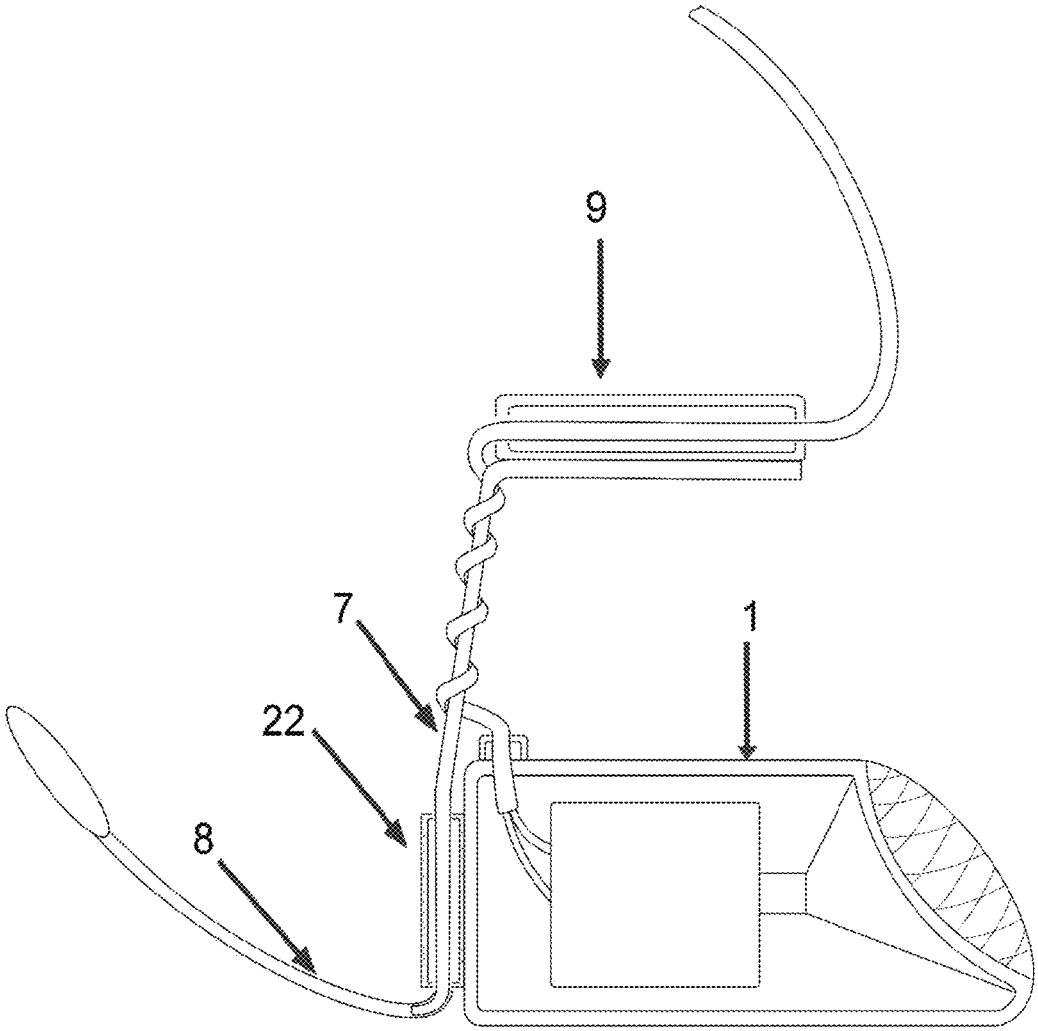

FIG. 5*a* and FIG. 5*b* show a rear and top view on the earphone in the "comfort" position displaying vector diagram of the projections of forces;

FIG. 6 and FIG. 7 show two ways of wearing the earphone by the user, according to the invention;

FIG. 8 and FIG. 9 show the relative positions of earphone parts when wearing earphone in two positions;

FIG. 10 and FIG. 11 show shaft embodiments;

FIG. 12 shows the earphone with a spring;

FIG. 13 and FIG. 14 show embodiments of the earphone, comprising a sleeve;

FIG. 15 and FIG. 16 show embodiments of the earphone for use in either user's ear;

FIG. 17 and FIG. 18 show embodiments of the earphone with a wire forming a loop;

FIG. 19 and FIG. 20 show different embodiments of the earphone with longitudinal shaft movement;

FIG. 21 shows the earphone comprising a brush-collector mechanism;

FIG. 22 shows the earphone comprising embouchure;

FIG. 23 and FIG. 24 show embodiments of the flexible element;

FIG. 25 shows the earphone comprising microphones;

FIG. 26 shows the earphone in a simple implementation of the invention; and

Figure 28:
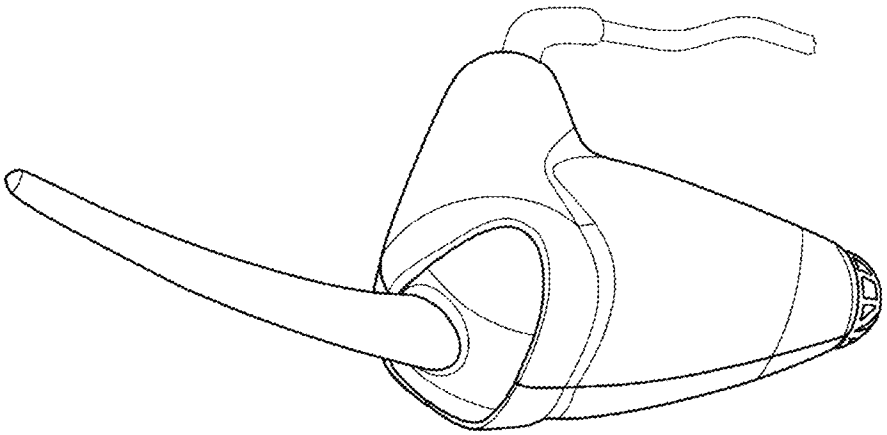
Figure 27:
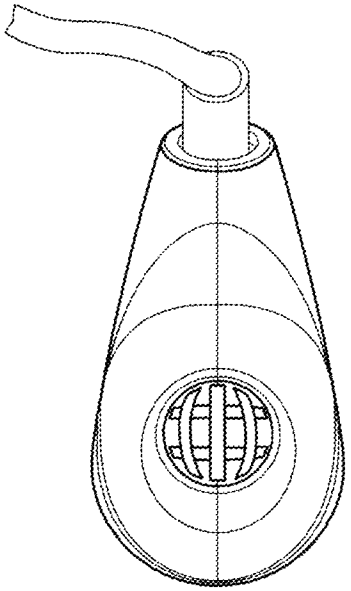
Figure 29:
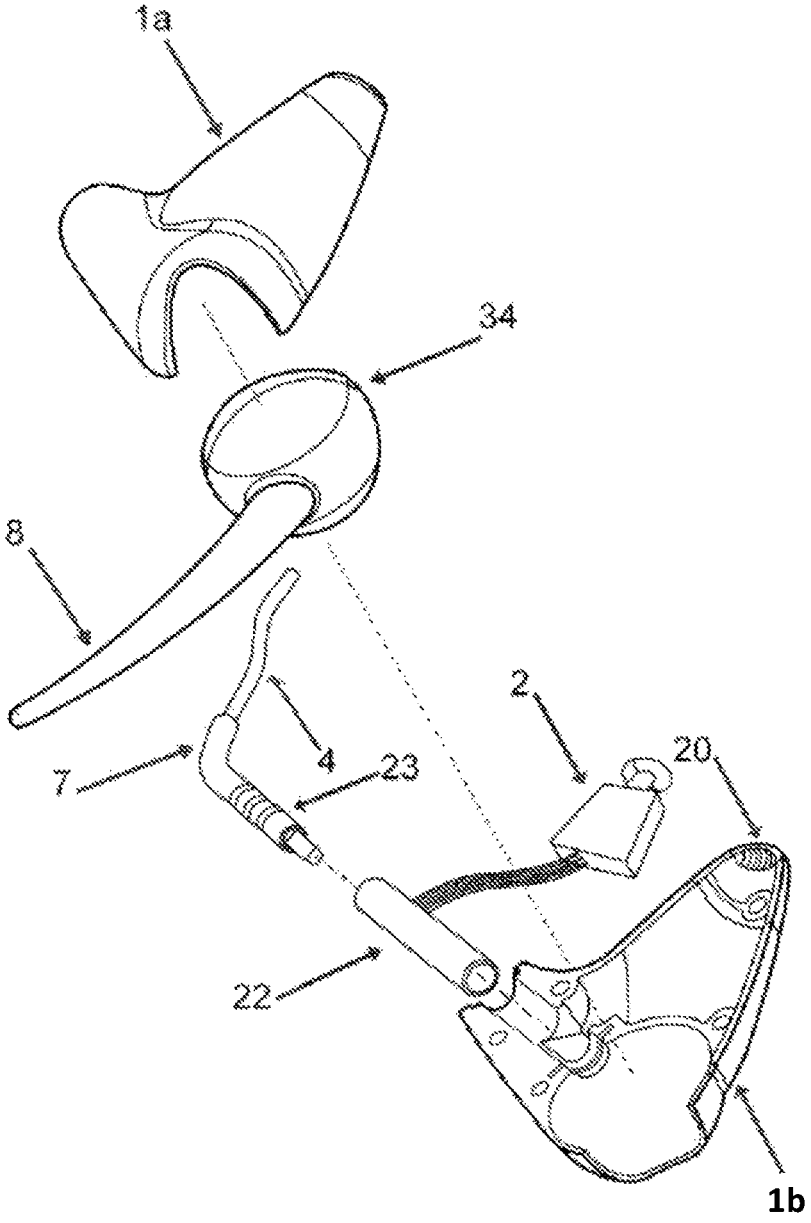

FIG. 27, FIG. 28 and FIG. 29 show the earphone in one embodiment of the invention.

DETAILED DESCRIPTION OF THE PREFERRED EMBODIMENTS

The terms and expressions used in this text, give the following meaning, which may differ from generally accepted meanings.

In-ear earphone—a device for personal listening to music, speech or other audio signals adapted to be located within the outer ear of the user.

Electroacoustic transducer—an electromagnetic energy wave converter into an acoustic wave (dynamic or reinforcing acoustic emitter).

Wire—a linear flexible electric conductors, containing one or more twisted or adjacent, isolated or non-isolated interconnected conductors, wires or individual cables, with the insulation over them or without insulation.

Terms such as "front", "rear", "right", "left", "upper", "lower" and their derivatives represent the position of parts of the earphone or earphone itself, taken with respect to the user's head, being in an upright position and looking straight and forward.

Figure 1:
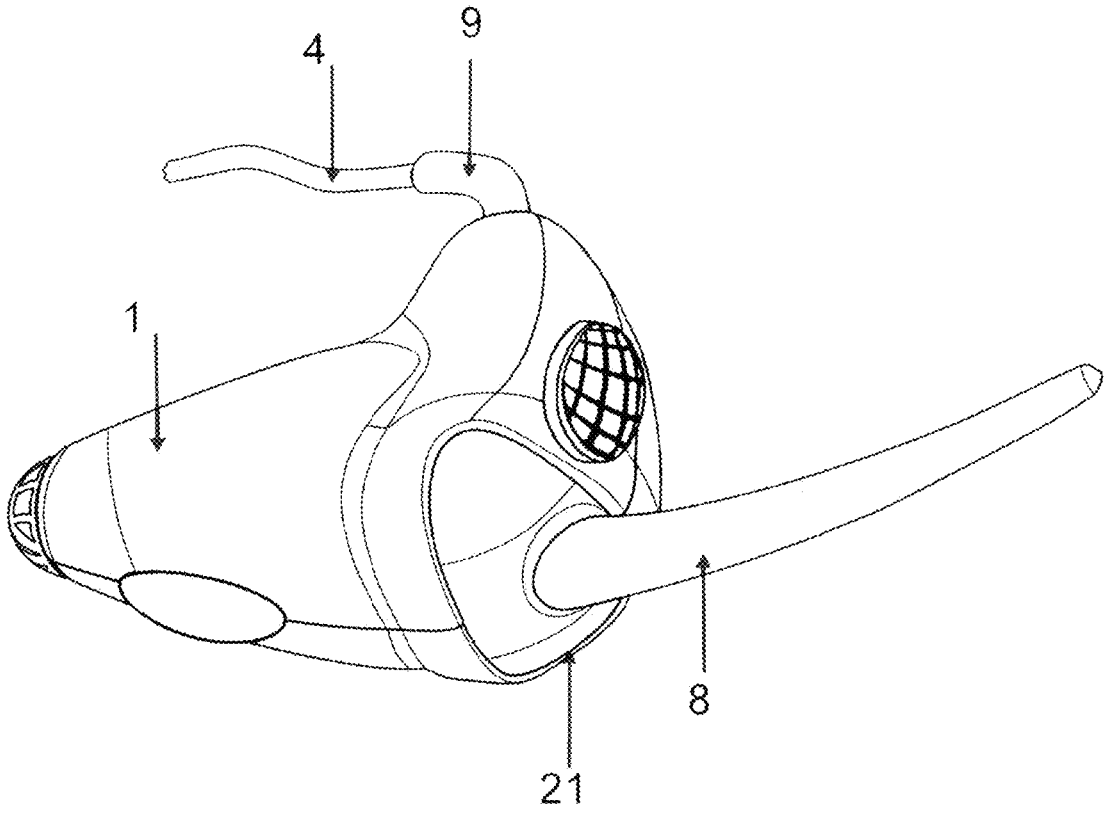
FIG. 1 is a perspective view of the earphone according to the invention.
Figure 2:
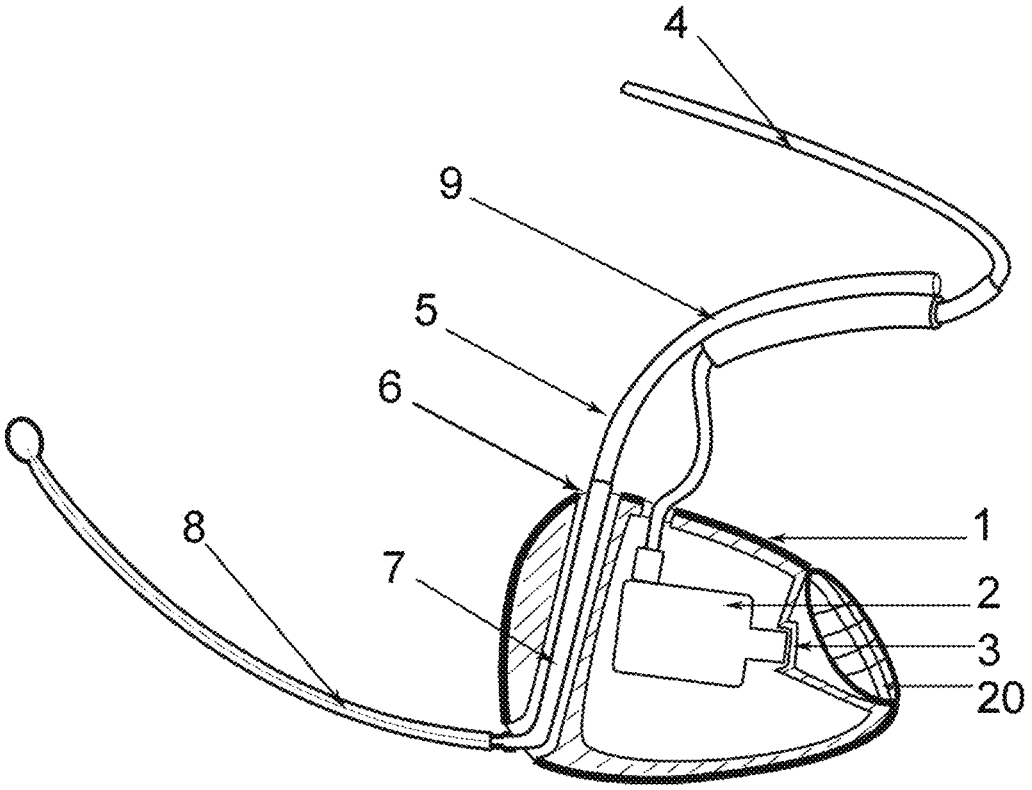
FIG. 2 shows a sectional view of the earphone in one embodiment showing the main functional elements of the invention.

We offer a new constructive solution for earphone illustrated in FIGS. 1, 2, which includes an acoustic part 1 with an electro-acoustic transducer 2 and a sound opening 3, wire 4 and mechanical part 5 with a cylindrical hinge 6, a shaft 7, a resilient member 8 and guide wire 9. The cylindrical hinge is made rigidly rotating. The earphone further comprises a return mechanism shaft. FIG. 1 shows an embodiment with a rigidly rotating hinge.

An in-the-ear earphone (FIG. 2) to be worn in two positions comprises an acoustic part 1, comprising at least one electroacoustic transducer 2, and at least one sound opening 3, intended for an acoustic output signal, generated by the electro-acoustic transducer 2, further, an in-the-ear earphone comprises a wire 4, electrically connected to the electroacoustic transducer 2, a mechanical part 5 coupled to the acoustic part 1 by means of a cylindrical hinge 6, and comprising a rotatable shaft 7, a resilient member 8 connected to one end of the shaft, wire guide 9 connected to the opposite end of the shaft 7, wherein, the said resilient member 8 and the guide 9 having its large part in one plane with the axis of shaft rotation, and are oriented essentially in opposite directions from the axis of shaft rotation, wherein the sound opening 3 is located at the end of acoustic part 1, opposing cylindrical hinge 6, the end of acoustic part 1 is configured so as to prevent clogging of the sound opening when wearing in any of the positions The cylindrical hinge 6 is formed so as to allow rotation of the shaft 7 by an angle $\alpha$, which is at least 70 degrees from a position wherein the guide 9 is oriented towards the sound opening 3. The wire 4 is mechanically connected to the guide 9.

Earphone design includes their use by the user in two positions. In position "quality" most of the earphone is placed inside the user's auditory canal, the sound opening 3 is deep within the auditory canal, and the earphone housing is maximally circumferentially adjacent to the walls of the external auditory canal and clogs it. In the "comfort" position earphone placed in the auricle without inside penetration of the user's auditory canal, and the sound opening 3 is located near the entrance to the auditory canal. This is necessary to provide a reliable fastening of earphones when worn by the user in both positions.

The proposed design of the headset includes the elastic element (resilient member) 8 in the form of a resilient rod of rounded or polygonal section, which is a continuation of the earphone rotary shaft 7 and is rigidly attached at one end at its lower part. Its purpose is in fixing the earphone in auricle, which is especially important in the headset "comfort" mode. The prior art discloses the resilient elements used as a spring spacers between the headset, set in the external auditory meatus, and antihelix wall, and fixing the earphone housing in the auricle by forces directed forward of the tragus and back toward the anti-tragus (e.g., an resilient element is known from US patent number 7,068,803). But in this case, fastening the earphone is only achieved by narrowly directed effect of two outward forces pressing earphone housing to tragus and the end of the resilient element to the anti-tragus. Such a local area of application of force can cause pain and is not conductive for lengthy wearing of earphones.

In the present application the earphone resilient member has a much greater length and when placing earphone in the auricle resilient member is directed substantially upwards, causing it to bend, having a smaller than the shorter resilient elements curvature radius r. Moment of resilient forces M at bending point is defined as: $M=EJ/r$, where E—Young's modulus, J—cross-section moment of inertia. The formula shows that by using a more flexible materials by increasing the length of the flexible member and, as a consequence, reducing the radius of curvature r, possible to create sufficient moment M to secure the earphone, and more resilient materials when bending deformation make efficient use of the element. For this purpose, it is necessary to lean the most part of the surface of convex arched resilient element against the upper inner wall of the antihelix.

Figure 3:
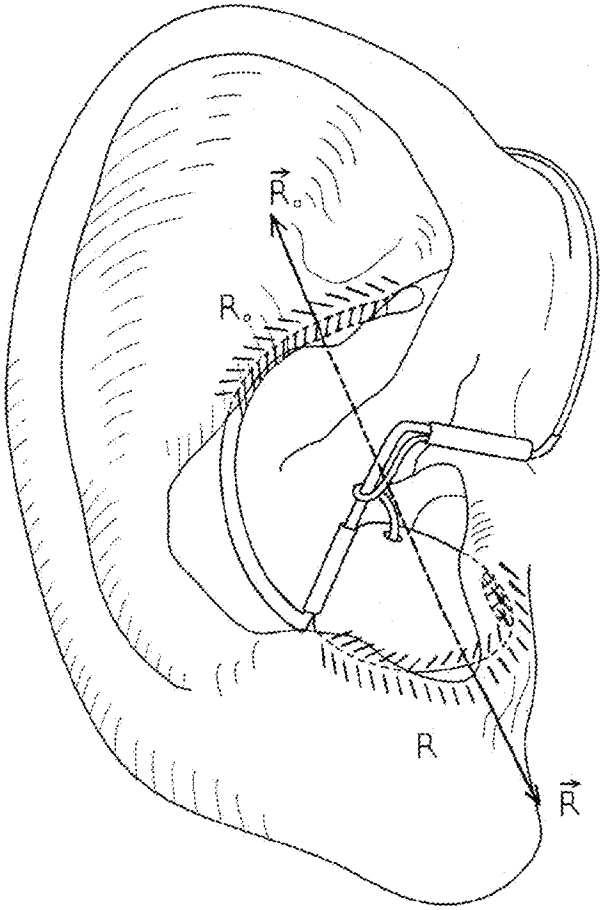
FIG. 3 shows the earphone in the ear in the "comfort" position displaying the force vectors.

FIG. 3 illustrates an earphone in the ear in the "comfort" position displaying the vectors of deformation force. These forces and deformation $\vec{R}$ and $\vec{R}_0$, compressing the arc of the resilient member 8, will be directed not only forward to the tragus but also have a vertical projection. The forces have a large application area and distribute the pressure along the lower surface of the headset on the area at the lower part of the cavity of the auricle (area R0 is shown by shading) and along the inner wall of the antihelix (area R is shown by shading), which, in turn, will contribute to lower the pressure force per unit area, which leads to a reduction in discomfort when wearing.

An additional factor that serves to secure the headset is a frictional force that occurs along the entire length of the resilient member.

Figure 4:
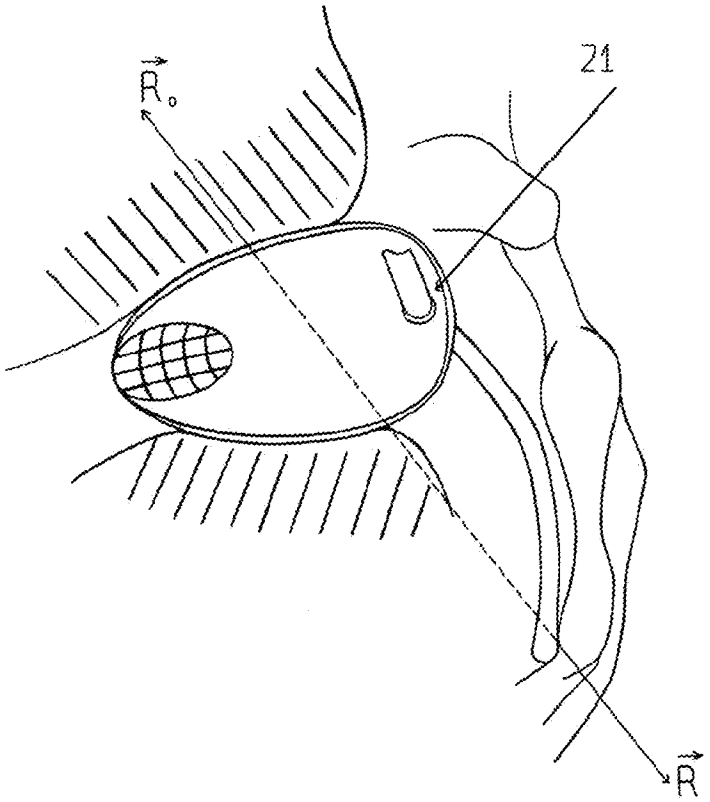
FIG. 4 shows the earphone in the ear in the "quality" position displaying the force vectors.

FIG. 4 shows a top view of the earphone, placed in a user's ear (in cross section) in the "quality" position displaying vectors of forces affecting the earpiece. Return mechanism 21 of cylindrical hinge seeking to return the rotating shaft to a position when the guide 9 is directed towards the sound opening 3, and together with the deformable resilient member 8 results in a force $\vec{R}$, which abuts the resilient member 9 to the inner surface of the anti-tragus and a force $\vec{R}_0$, which guides the earphone housing to abut the front wall of the ear canal.

In the upper part of our earphone, the guide for wire 9, in conjunction with the curved upper part of the shaft 7, form a semi-earhook. The use of this constructive solution allows to further secure the earpiece in the ear. At the output of the earphone housing, the upper part of the shaft 7 is bent sufficiently, to perform as a lever with point of support at the front ligament of the auricle (FIG. 5*a*). When wearing the headset by the user, when the wire 9 goes around the top of the auricle, when the wire 9 is pulled (force $\vec{T}$), a moment of tension force $M_T$ turns the earphone towards the auricle canal, improving fastening of the earphone in the auricle.

These conditions are optimally performed in a stereo headset, having in its composition a suboccipital unit (RU patent number 2,520,184). When using the earphones as a stereo headset, the vector sum of the forces affecting the earphones of the structure, when worn, further secures them into the ear.

In the "comfort" position, the resilient cartilage of the auricle tends to push the earphone out. The ejection force is applied perpendicular to the axis of rotation of the cylindrical joint, which leads to its rotation and loss of earphone. To counteract this force, it is effective the use of the return mechansim shaft.

FIGS. 5*a* and 5*b* are views from above and behind (ear shown in cross-section) on the headset in the "comfort" position with an indication of the vector diagram of the projections of the forces. Force $\vec{Q}_N$ (FIG. 5*a*) pushes the headset from the ear. It is balanced by the forces of interaction of the earphone housing with the shaft $\vec{N}$ and $\vec{N}1$. The return mechanism creates a force couple $\vec{F}_c$ and $\vec{F}_e$ or torque $\vec{M}_c$, which compensates for torque $\vec{Q}_N$ relative to the axis of the shaft. Along the horizontal forces, the earphone is affected by a vertical force, a diagram of which is shown in FIG. 5*b*. Force $\vec{P}$—is the vertical pressure force on the earpiece. It includes earphone gravity, the vertical component of the pressure force of the deformed elastic member, and the force transmitted to the bent portion of the shaft of the tension wire ($\vec{T}$—wire tension force) coming from the earpiece. Wire tension force $\vec{T}$, using the suboccipital unit, is oriented not only up, but also slightly medially. Force $\vec{N}$ and $\vec{N}1$ are the forces of shaft reaction. Force $\vec{Q}$ arises from the resilience of tissue of the auricle from the pressure of earphone; it is perpendicular to the axis of the cylindrical joint and tends to push the earphone from of the auricle. Force $\vec{Q}$ has a vertical component $\vec{Q}_p$, compensating for force $\vec{P}$ and horizontal component $\vec{Q}_N$, compensating for force $\vec{N}$ and $\vec{N}1$.

The guide 9 in the earphone (FIG. 6 and FIG. 7) has a length such that when worn in any of these two positions, the guide is placed at the top of the auricle clipping 10 between leg curl 11 and upper-tragus tubercle 12, and the place of connection of wire 4 and the guide located on the surface of the front ligament of the auricle 13, and the wire goes around the ear 14 from the top. The acoustic part 1 is shaped so that when worn in one of the positions corresponding to the shaft rotation at an angle α of 70-90 degrees, the acoustic part 1 is at least partially housed within the user's outer auditory canal 15, wherein the sound opening 3 is recessed into the external auditory canal, a resilient member 8 is located in the cavity of the auricle 16 behind anti-tragus 17 and thus can serve to extract the earphone from the external auditory canal.

The acoustic part 1, when the user wears the headset in the other above-mentioned position, corresponds to orientation of the guide 9 in the direction of the sound opening 3, located in the cavity of the auricle between the tragus 18 and anti-tragus 17, the sound outlet 3 is located in the vicinity of the entrance of the external auditory canal 15. The resilient element 8 abuts the lower leg of antihelix 19 and thus serves to keep the earpiece in the auricle.

Thus, the technical objective is solved by creating an earphone whose shape allows the use in two positions. One of the positions (FIG. 6), let's call it "quality", corresponds to the position when most of the earphone is placed inside the user's ear canal 15, the sound opening 3 is directed toward the eardrum and is located deep inside the ear canal and the earphone housing maximum adjacent to the circumferential walls of the external auditory canal and clogs it. This earphone positions provides better passive noise reduction, reduction of the volume of air rocking by the membrane, resulting in improved sound quality.

The second position (FIG. 7) let's call it "comfort", corresponds to the position of the earphone in the auricle without penetration of the ear canal, the sound opening 3 is located near the entrance to the ear canal, the ear canal is free. This position allows the use of earphones for a long time without overloading the ear canal, without irritating a pressure-sensitive surface of membranous cartilage (front) of the external auditory canal, and also allows the user to hear surrounding sounds.

FIG. 6 and FIG. 7 also show a way of wearing in-the-ear earphone in where the earphone (FIG. 2) comprising an acoustic part 1 comprising at least one electroacoustic transducer 2 and at least one sound opening 3 designed to output an acoustic signal generated by the electroacoustic transducer; earphone also comprising a wire 4, electrically connected with the electroacoustic transducer 2, the mechanical part 5, connected with the acoustic part 1 through a cylindrical hinge 6 and having a shaft 7, rotatable, the resilient element 8, connected to one end of the shaft, a guide wire 9 connected to the opposite end of the shaft, wherein, the resilient member 8 and the guide 9 are located at its greater part in the same plane with the axis of the rotation of the shaft and oriented substantially in opposite directions from the axis of rotation of the shaft, wherein the sound opening 3 is located at the end of the acoustic part, opposing cylindrical hinge 6. The end portion of acoustic part excludes the possibility of clogging the sound opening when wearing in any of the positions. The cylindrical hinge 6 permits rotation of the shaft 7 by an angle α, which is at least 70 degrees from the position wherein the guide 9 is oriented towards the sound opening 3, the wire 4 is mechanically connected with the guide 9.

A method wherein, for arranging the sound opening 3 in the external auditory canal 15 (FIG. 6), the user turns the shaft 7 at an angle α, which is at least 70 degrees from a position wherein the guide 9 is oriented towards the sound opening 3, arranges acoustic part 1 within the external auditory openings, wherein a user places the resilient member 8 in the cavity of the auricle behind anti-tragus 17, as for arranging the sound opening 3 on the outside from the entrance of the external auditory canal 15 (FIG. 7), a user rotates the shaft 7 to a position where the upper part of the shaft directed towards the acoustical opening 3, arranges acoustic part 1 in the cavity of the auricle between the tragus 18 and anti-tragus 17, a resilient member 8 in the in the cavity of the auricle behind the anti-tragus 17, wherein, when worn in any of the two positions, the user places the guide wire 9 at the top clipping of the ear auricle 10 between the leg curl 11 and upper-tragus tubercle 12, place of connection of wire 4 and the guide on the surface of the front ligament of the auricle 13, and wire from the top of the auricle 14.

FIG. 8 and FIG. 9 are examples of relative positions of the left and right earphone in both positions. FIG. 8 shows top view of the left earphone, where the position "quality" corresponds the angle α in the range of 70 to 90 degrees, when set to "comfort", the angle α is equal to or close to zero. Similarly, the change in positional relationship of parts of right earphone (FIG. 9) when the angle α is changing. The range of the angle α from 70 to 90 degrees in the "quality" position allows taking into account the anatomical structure of the user's ear.

In order to prevent the ejection of the earphone by cartilaginous tissue of the ear in the position "comfort", a cylindrical hinge may be formed so as to provide sufficient rigidity for shaft rotation, preventing free rotation of the shaft from that position, wherein the wire guide 9 is oriented towards the sound opening 3.

Given that in the position "comfort", the acoustic part 1 of the earphone with the sound opening 3 arranged at its front, can be pressed against the tragus, it is possible to use several methods of forming the sound openings to prevent it from clogging when wearing the earphone in the two positions, namely; to make the opening of an irregular shape, to offset relative to the longitudinal axis of the earphone; to increase the diameter of the opening; to place at least two sound openings on different planes; additionally set a convex large-mesh grille. Any combination of these methods is possible.

In preferred embodiments, (FIG. 1) the earphone further comprises a protective grille 20, designed for protection from clogging the sound opening.

In some embodiments of the earphone (FIG. 10), at least one end of the shaft 7 is curved about the axis of rotation.

In many embodiments of the earphone (FIG. 11), both ends of the shaft 7 are bent in opposite directions from the axis of rotation.

In various embodiments, the earphone further comprises a return mechanism 21, which returns shaft to a position where the guide 9 is oriented towards the sound openings, and the angle α is close to or equal to 0. The return mechanism 21 (FIG. 12) may be a cylindrical helical spring loosely wound around the shaft 7, wherein one end of the spring is attached to the acoustic portion 1 and the other end of the spring is attached to one end of the shaft 7. FIG. 8 shows the right earphone in the "comfort" position. In some embodiments, the return mechanism can be configured as a bending spring, one end of which is attached to one end of the shaft and the other end is attached to the acoustic part 1 of the earphone.

In many embodiments of the earphone (FIG. 13 and FIG. 14), a cylindrical hinge 6 further comprises at least one sleeve 22 in which the shaft 7 is located.

In preferred embodments of the earphone (FIG. 15 and FIG. 16) the mechanical part 5 may be arranged to rotate the shaft 7 at an angle α in the range of 70 to 90 degrees in either direction from a position wherein the guide 9 is oriented in the direction toward the sound opening 3.

FIG. 15 and FIG. 16 shows an embodiment of the earphone implemented to be worn in the either ear.

In the embodiments in which the rotation of the shaft is provided in any direction and use of the earphone is available in either ear, exact location of the earphone is carried out by hardware methods, e.g., using a microphone and (or) accelerometers placed in the earphones.

In various embodiments (FIG. 2) at the section between places of fastening of the wire 4 to the guide 9 and to the acoustic transducer 2, the wire 4 may have additional slack to allow rotation of the shaft 7.

In some cases, this portion of the wire 4 has several loose rounds (FIG. 14 and FIG. 16), entwined around the upper portion of the shaft, the wire 4 may be formed into a loose, slack cylindrical spring entwined in a similar manner.

In some cases, this portion of the wire 4 having slack to ensure the necessary rotation of the shaft, located inside the protective shell of the earphone.

In some embodiments of the earphone (FIG. 17 and FIG. 18) the shaft 7 and a resilient member 8 may be made hollow, the wire 4 is placed inside the shaft 7 and the resilient member 8 and further mechanically fastened to the lower end of the shaft 7, forming a loop, and the portion of wire between places of additional fastening of wire to the lower end of the shaft and to the electroacoustic transducer 2 has an extra slack.

Where possible the partial pull of the wires inside the shaft 7, the user can adjust the length of the wire loop that serves to hold the earphone in the auricle.

In some embodiments, the wire 4 may further comprise an electric socket on the section between the places of fastening to the upper part of the shaft 7 and to the acoustic transducer 2.

In many embodiments of the earphone (FIG. 19) the shaft 7 is arranged for longitudinal movement in the cylindrical hinge 6. Also, the earphone may further comprise a twisted cylindrical compression spring 21, wound around the shaft 7 between the guide 9 and acoustics part 1 or (FIG. 20) part of the wire 4 located between the guide 9 and the acoustic part 1 may be implemented as a twisted cylindrical compression spring wound around the shaft 7.

In various embodiments of the earphone (FIG. 21) guide 9 and the shaft 7 can be made hollow, the wire 4 positioned within the cavities, and a cylindrical hinge may further comprise brush-commutator assembly 23, adapted to electrically connect the wire 4 with the electroacoustic transducer 2.

In some embodiments (FIG. 22) the earphone further comprises an embouchure 24, and the acoustic part 1 is further provided with fasteners 25 for it.

In some embodiments, the earphone may further comprise a soft cover designed to fit over the acoustics part 1 of the earphone, and in some embodiments, at least partially, one the resilient element 8.

The cover has at least one opening for the sound output and located opposite the sound opening 3 when wearing the cover. The earphone may be provided with a set of covers of different sizes, textures and colors, using which the user adjusts the size, shape and color of the earphone. When using a microphone, additionally placed on the earphone, the soft cover can serve as an additional windscreen to the microphone, wherein the cover may at least partially serve as a resilient element of the earphone.

In advantageous embodiments, the (FIG. 10) the resilient element 8 may be detachable. This allows using a set of replaceable resilient elements of different lengths and rigidity to meet user's requirements for comfort wearing and fixing of the earphone. The resilient member may be made of rubber, a spiral spring, a combination of these materials, or be an integral part of the cover. In various embodiments (FIG. 23 and FIG. 24), the resilient element 8 further comprising a longitudinal rigid thread 26, secured within the resilient member 8, and the resilient member 8 may be arranged to adjust its length. It may be advisable to insert a sturdy thread 26 longitudinally inside the resilient member 8, where the thread 26 will prevent breakage of the resilient element in the case of stretching the resilient element of earphone from deep intra-canal position. The thread 26 is fixed in the resilient element by a washer 27 or secured to the threaded sleeve 28.

In some embodiments of the earphone, the resilient element 8 is formed as a loop.

The headset, in the embodiment illustrated in FIG. 19, further comprises at least one latch, adapted to hold the shaft 7, at least in one of the positions. The earphone shown in FIG. 19 intended to be worn in the either ear and comprises latches 29, 30 and 31, where the latch 31 is designed to hold the shaft 7 when wearing earphone in either ear in the "comfort" position, latch 29 is engaged in the "quality" position when using earphone as a right, latch 30—using earphone as a left, respectively.

In some embodiments (FIG. 25) the earphone may further comprise at least one microphone 32, and may further comprise a bone conduction microphone 33. The earphone may further comprise an air conduction microphone to form a microphone array in the wearable headset or to provide an active noise-suppression when listening to music; a bone conduction microphone is designed to remove the voice carrier with minimal noise.

A simple embodiemtn of the earphone is shown in FIG. 26. The acoustic part 1 can have a simple cylinder shape, to which through the sleeve 22 attached the shaft 7 and the resilient member 8 and the guide 9. Earphone shape close to a cylindrical or a shape of a cylinder flattened on both sides and elongated in the longitudinal direction. The length of a fixed rotating shaft 7 portion may be from 5 mm to 15 mm, length of the resilient member 8 formed in such a way that it may be a continuation of the curved bottom of the shaft, equal to, depending on the Entre-metric data user, from 15 to 30 mm. The size and shape of the upper part of the shaft, together with the guide 9 attached to the shaft 7, are equal to 15-25 mm, which allows the use of this part of earphone as a abutting into front ligament of the auricle, which prevents loss of earphone when wearing in either of the two positions.

In one embodiment of the earphone (FIG. 27, 28 and 29) connection of the shaft with the resilient element is made in the form of a ball, rotating in a cavity of the spherical hinge. The design features of the earphone are presented in FIG. 25. The earphone acoustic portion 1 is made of two parts 1*a* and 1*b*. The shaft 7 is curved at one end and is attached to the acoustic part 1 by means of a sleeve 22. On the sleeve 22 and the shaft 7 there is a brush-collector mechanism connecting the wire 4 with electro-acoustic transducer 2. In this embodiment, the use of electro-acoustic transducer 2 is provided with a balanced armature, reducing the overall size and leaving room for placement of microphones in the acoustic part 1 of the earphone or the cavity of the rotating sphere. The flexible element 8 comprises a spherical socket 24, firmly placed in the respective cavity of the acoustic part 1 and latching in it by the shaft 7.

When creating earphones, it is best to make the earphones maximally flat and the least hook-shaped, since when using earphones if the device is worn on the body, being removed from the ear, the earphones are positioned on the body under the clothing. Furthermore, some wearable devices provide for the winding of wire of the earphones followed by placing the earphones in a special cavity or pocket of the worn device. The flatter the earphones, the more comfortable will be wearing them on the body in a variety of devices of wearable electronics.

In order to prevent the ejection of the earphone by cartilaginous tissue of the ear in the position "comfort", a cylindrical hinge may be formed so as to provide sufficient rigidity for shaft rotation, preventing free rotation of the shaft from that position, wherein the guide wire oriented towards the sound opening.

Given that in the position "comfort" acoustic part of the earphone with the sound opening arranged at its front, can be pressed against the tragus, it is possible to use several methods of forming the sound opening to prevent it from clogging when wearing the earphone by the user in two positions, namely: to make opening of irregular shape, offset relative to the longitudinal axis of the earphone; increase the diameter of the opening; placing at least two sound openings on different planes; additionally set a convex large-mesh grille. Any combination of these methods is possible.

In some embodiments, the return mechanism can be configured as a bending spring, one end of which is attached to one end of the shaft 7 and the other end is attached to the acoustic part 1 of the earphone.

The headset, in the embodiment illustrated in FIG. 19 further comprises at least one latch, adapted to hold the shaft 7, at least in one of the positions. The earphone shown in FIG. 19 is intended to be worn in the either ear of the user and comprises latches 29, 30 and 31, where the latch 31 is designed to hold the shaft 7 when wearing earphone in either ear in the "comfort" position, latch 29 is engaged in the "quality" position when using the earphone as a right, latch 30—using the earphone as a left, respectively.

In preferred embodiments of the earphone (FIG. 15 and FIG. 16) the mechanical part may be arranged to rotate the shaft 7 at an angle $\alpha$ in the range of 70 to 90 degrees in either direction from a position wherein the guide is oriented in the direction toward the sound opening. FIG. 15 and FIG. 16 shows an embodiment of the earphone implemented to be worn in the user's either ear.

In the embodiments in which the rotation of the shaft is provided in any direction and use of the earphone is available in either ear, the exact location of the earphone is carried out by hardware methods, e.g., using a microphone and (or) accelerometers placed in the earphones.

In various embodiments (FIG. 2) in the area between places of fastening of the wire 4 to the guide 9 and to the acoustic transducer 2, the wire 4 may have additional slack to allow rotation of the shaft 7.

In some cases, this portion of the wire 4 has several loose rounds (FIG. 14 and FIG. 16), entwined around the upper portion of the shaft, the wire 4 may be formed into a loose, slack cylindrical spring entwined in a similar manner.

In some cases, this portion of the wire 4 having slack to ensure the necessary rotation of the shaft, located inside the protective shell of the earphone.

Where possible the partial pull of the wires inside the shaft 7, the user can adjust the length of the wire loop that serves to hold the earphone in the auricle.

In some embodiments, the wire 4 may further comprise an electric socket on the section between the places of fastening to the upper part of the shaft 7 and to the acoustic transducer 2.

In many embodiments of the earphone (FIG. 19) the shaft 7 is arranged for longitudinal movement in the cylindrical hinge 6. Also, the earphone may further comprise a twisted cylindrical compression spring 21, wound around the shaft 7 between the guide 9 and acoustic part 1 or (FIG. 20) part of the wire 4 located between guide 9 and acoustic part 1 may be implemented as a twisted cylindrical compression spring wound around the shaft.

In various embodiments of the earphone (FIG. 21) the guide 9 and the shaft 7 can be made hollow, wire 4 positioned within the cavities, and a cylindrical hinge may further comprise brush-commutator assembly 23, adapted to be electrically connected of the wire with the electroacoustic transducer 2.

In some embodiments (FIG. 22) the earphone further comprises an embouchure 24, and the acoustic part 1 is further provided with fasteners 25 for it.

In advantageous embodiments, (FIG. 10) the resilient element 9 may be made detachable. This allows make a set of replaceable resilient elements of different lengths and rigidity to meet the user's requirements for comfort wearing and fixing of the earphone. The resilient member may be made of rubber, a spiral spring, a combination of these materials, or be an integral part of the cover.

In various embodiments (FIG. 23 and FIG. 24), the resilient element 8 further comprising a longitudinal rigid thread 26, secured within the resilient member 8, and the resilient member may be arranged to adjust the length. It is advisable to insert a sturdy thread 26 longitudinally inside the elastic member 8, wherein thread 26 will prevent breakage of the resilient element 8 in the case of stretching the resilient element by a washer 27 or secured to the threaded sleeve 28. In various embodiments, the resilient element 8 may have an adjustable length.

In some embodiments of the earphone the resilient element is formed as a loop.

In many embodiments of the earphone (FIG. 13 and FIG. 14), the cylindrical hinge 6 further comprises at least one sleeve 22 in which is located the shaft 7.

A simple embodiment of the earphone is shown in FIG. 26. The acoustic part 1 can have a simple cylinder shape, to which, through the sleeve 22, attached shaft 7 and the resilient member 8 and the guide 9. Earphone shape close to a cylindrical or has the shape of a cylinder flattened on both sides and elongated in the longitudinal direction. The length of a fixed rotating shaft portion may be from 5 mm to 15 mm, length of the resilient member 8 formed in such a way that it may be a continuation of the curved bottom of the shaft, equal to, depending on the Entre-metric data user, from 15 to 30 mm. The size and shape of the upper part of the shaft, together with the guide attached to the shaft, are equal to 15-25 mm, which allows the use of this part of earphone as a abutting into front ligament of the auricle, which prevents loss of earphone when wearing in either of two positions.

The invention claimed is:

1. An in-the-ear earphone to be worn in two positions, comprising:

an acoustic part comprising at least one electroacoustic transducer and at least one sound opening outputting an acoustic signal generated by the electroacoustic transducer, a wire, electrically connected with the electroacoustic transducer, a mechanical part, connected with the acoustic part through a cylindrical hinge and having a rotatable shaft, a resilient element, connected to one end of the shaft, a wire guide connected to an opposite end of the shaft, wherein the resilient element and the wire guide are located at a thicker portion of the acoustic part in the same plane with an axis of rotation of the shaft and oriented substantially in opposite directions from the axis of rotation of the shaft;

wherein the at least one sound opening is located at an end of the acoustic part, opposing the cylindrical hinge;

the end portion of the acoustic part excluding a possibility of plugging the sound opening when the earphone is worn in the two positions;

the cylindrical hinge permitting a rotation of the shaft by an angle $\alpha$ of at least 70 degrees, from a first position of the two positions, when the wire guide is oriented towards the sound opening to a second position of the two positions; and the wire is mechanically connected with said wire guide.

2. The earphone of claim 1, wherein, the wire guide has such a length that when worn in any of the two positions, the wire guide is placed at a top clipping of an auricle between a leg curl and an upper-tragus tubercle, wherein, a place of connection of the wire and the wire guide is located on a surface of a front ligament of the auricle, wherein the wire goes around an ear from a top of the ear, the acoustic part is shaped so that when worn in the second position, the acoustic part at least partially housed within a user's outer auditory canal, wherein the sound outlet is recessed into an external auditory canal, the resilient element is located in a cavity of the auricle behind an anti-tragus;

the acoustic part when worn in the first position, is located in the cavity of the auricle between a tragus and the anti-tragus, the sound outlet is located in a vicinity of an entrance of the external auditory canal, and the resilient element abuts a lower leg of an antihelix.

3. The earphone of claim 1, wherein the earphone further comprises a protective grille.

4. The earphone of claim 1, wherein the at least one end of the shaft is curved about the axis of rotation.

5. The earphone of claim 4, wherein both ends of the shaft are bent in opposite directions from the axis of rotation.

6. The earphone of claim 1, wherein the earphone further comprises a return mechanism, which returns the shaft to the first position.

7. The earphone of claim 6, wherein the return mechanism is a cylindrical helical spring loosely wound around the shaft, wherein one end of the cylindrical helical spring is attached to the acoustic part and the other end of the cylindrical helical spring is attached to one end of the shaft.

8. The earphone of claim 6, wherein the return mechanism is a bending spring, one end of which is attached to one end of the shaft and the other end is attached to the acoustic part of the earphone.

9. The earphone of claim 1, wherein the cylindrical hinge further comprises at least one sleeve around the shaft.

10. The earphone of claim 1, wherein the mechanical part rotates the shaft at the angle $\alpha$ in a range of 70 to 90 degrees in either direction from the first position.

11. The earphone of claim 10, wherein the earphone can be worn in either ear.

12. The earphone of claim 1, wherein at a section between places of fastening of the wire to the wire guide and to the acoustic transducer, the wire has additional slack to allow the rotation of the shaft.

13. The earphone of claim 1, wherein the shaft and the resilient element are hollow, wherein wire is placed inside the shaft and the resilient element and is further mechanically fastened to a lower end of the shaft, forming a loop, and a portion of the wire between places of additional fastening of wire to the lower end of the shaft and to the electroacoustic transducer has an extra slack.

14. The earphone of claim 1, wherein the wire further comprises an electric socket on a section between places of fastening to an upper part of the shaft and to the electroacoustic transducer.

15. The earphone of claim 1, wherein the shaft is adapted for longitudinal movement in the cylindrical hinge.

16. The earphone of claim 15, wherein the earphone further comprises a twisted cylindrical compression spring, which is wound around the shaft between the wire guide and the acoustic part.

17. The earphone of claim 15, wherein a part of the wire, which is located between the wire guide and the acoustic part, is a twisted cylindrical compression spring wound around the shaft.

18. The earphone of claim 2, wherein the wire guide and the shaft are hollow, the wire is positioned within the shaft, and the cylindrical hinge further comprises a brush-commutator assembly to electrically connect the wire with the electroacoustic transducer.

19. The earphone of claim 1, wherein the earphone further comprises an embouchure, and the acoustic part includes fasteners for the embouchure.

20. The earphone of claim 1, wherein the earphone further comprises a soft cover that fits over the acoustic part, wherein the soft cover has at least one opening for the sound output and located opposite the sound opening when wearing the soft cover.

21. The earphone of claim 1, wherein the resilient element is detachable.

22. The earphone of claim 1, wherein the resilient element further comprises a longitudinal rigid thread, which is secured within the resilient element.

23. The earphone of claim 1, wherein the resilient element has an adjustable length.

24. The earphone of claim 1, wherein the resilient element is formed as a loop when worn by a user within an auricle.

25. The earphone of claim 1, wherein the earphone further comprises at least one latch, adapted to hold the shaft, at least in one of the positions.

26. The earphone of claim 1, wherein the earphone further comprises at least one microphone.

27. The earphone of claim 26, wherein the microphone is a bone conduction microphone located within an auditory canal or within an auricle when worn by a user.

28. An in-the-ear earphone to be worn in two positions, comprising:

an acoustic part comprising at least one electroacoustic transducer and at least one sound opening that outputs an acoustic signal generated by the electroacoustic transducer, a wire electrically connected with the electroacoustic transducer, a mechanical part, connected with the acoustic part through a cylindrical hinge and having a rotatable shaft, a resilient element, connected to one end of the shaft, a guide for the wire connected to an opposite end of the shaft, wherein the resilient element and the guide are located at a thicker portion of the acoustic part in the same plane as an axis of rotation of the shaft and oriented substantially in opposite directions from the axis of rotation of the shaft;

wherein the sound opening is located at an end portion of the acoustic part, opposing the cylindrical hinge;

the end portion of acoustic part does not plug the sound opening when the earphone is worn in any of the two positions;

the cylindrical hinge permitting rotation of the shaft by an angle $\alpha$ to a second position, which is at least 70 degrees from a first position when the guide is oriented towards the sound opening;

the wire is mechanically connected with the guide;

wherein, the guide has such a length that when worn in any of the first and second positions, the guide is placed at a top clipping of an auricle between a leg curl and an upper-tragus tubercle, wherein, a place of connection of the wire and the guide is located on a surface of a front ligament of the auricle, wherein the wire goes around an ear from the top;

the acoustic part is shaped so that when worn in the second position, the acoustic part is at least partially within an outer auditory canal, wherein the sound outlet is recessed into an external auditory canal, wherein the resilient element is located in a cavity of the auricle behind an anti-tragus and thus can be used to extract the earphone from the external auditory canal.

29. The earphone of claim 28, wherein, the earphone further comprises a protective grille.

30. The earphone of claim 28, wherein at least the one end of the shaft is curved about the axis of rotation.

31. The earphone of claim 30, wherein both ends of the shaft are bent in opposite directions from the axis of rotation.

32. The earphone of claim 28, wherein the earphone further comprises a return mechanism, for returning shaft to the first position.

33. The earphone of claim 32, wherein the return mechanism is a cylindrical helical spring loosely wound around the shaft, wherein one end of the cylindrical helical spring is attached to the acoustic part and the other end of the cylindrical helical spring is attached to one end of the shaft.

34. The earphone of claim 32, wherein the return mechanism is a bending spring, one end of which is attached to one end of the shaft and the other end is attached to the acoustic part.

35. The earphone of claim 28, wherein the earphone further comprises at least one latch, adapted to hold the shaft, at least in one of the two positions.

36. The earphone of claim 28, wherein the mechanical part rotates the shaft at an angle $\alpha$ in a range of 70 to 90 degrees in either direction from the first position.

37. The earphone of claim 36, wherein the earphone is wearable in either ear.

38. The earphone of claim 28, wherein at a section between places of fastening of the wire to the guide and to the electroacoustic transducer, the wire has additional slack to allow rotation of the shaft.

39. The earphone of claim 28, wherein the shaft and the resilient element are hollow, the wire is placed inside the shaft and the resilient element and is further mechanically fastened to a lower end of the shaft, forming a loop, wherein the portion of wire between places of additional fastening of wire to the lower end of the shaft and to the electroacoustic transducer has an extra slack.

40. The earphone of claim 28, wherein the wire further comprises an electrical connector on a section between the fastening places to an upper part of the shaft and to the electroacoustic transducer.

41. The earphone of claim 28, wherein the shaft is adapted for longitudinal movement within the cylindrical hinge.

42. The earphone of claim 41, wherein the earphone further comprises a cylindrical helical compression spring, which is wound around the shaft between the guide and the acoustic part.

43. The earphone of claim 41, wherein a portion of the wire disposed between the guide and the acoustic part is formed as a cylindrical helical compression spring wounded around the shaft.

44. The earphone of claim 28, wherein the guide and the shaft are hollow, the wire positioned within the guide and the shaft, and the cylindrical hinge further comprises a brush-commutator assembly for electrically connecting the wire with the electroacoustic transducer.

45. The earphone of claim 28, wherein the earphone further comprises an embouchure, wherein the acoustic part includes fasteners for the embouchure.

46. The earphone of claim 28, wherein the earphone further comprises a soft cover that fits over the acoustic part of the earphone, wherein the soft cover has at least one opening for the sound output and is located opposite the sound opening when wearing the cover.

47. The earphone of claim 28, wherein the resilient element is detachable.

48. The earphone of claim 28, wherein the resilient element further comprises a longitudinal rigid thread, which is secured within the resilient element.

49. The earphone of claim 28, wherein the resilient element has an adjustable length.

50. The earphone of claim 28, wherein the resilient element is formed as a loop.

51. The earphone of claim 28, wherein the cylindrical hinge further comprises at least one sleeve.

52. The earphone of claim 28, wherein the earphone further comprises at least one microphone.

53. The earphone of claim 52, wherein the microphone is a bone conduction microphone.

54. A method of wearing an in-ear-canalphone comprising:

with an acoustic part having at least one electro-acoustic transducer and at least one sound opening for an acoustic signal output generated by the electro-acoustic transducer, a wire electrically coupled to the electro-acoustic transducer, a mechanical portion connected to the acoustic part through a cylindrical hinge and comprising a rotatable shaft, a resilient member connected to one end of the shaft, a guide connected to an opposite end of the shaft, wherein the resilient member and the guide are located at a thicker portion of the acoustic part in one plane with the axis of rotation of the shaft, and oriented in substantially opposite directions from the axis of rotation of shaft, wherein the sound opening is located at an end of the acoustic part, opposing to the cylindrical hinge, where the end of the acoustic part prevents plugging of the sound outlet during wearing in any of the two positions, the cylindrical hinge allows rotation of the shaft by an angle $\alpha$ to a second position, which is at least 70 degrees from a first position wherein the guide is oriented towards the sound opening, and the wire is mechanically connected to the guide, wherein, for arranging the sound opening inside of an external auditory canal, a user turns the shaft at an angle $\alpha$ to the second position, arranges the acoustic part inside of the external auditory openings, wherein a user places the resilient member in a cavity of an auricle behind an antitragus;

for arranging the sound opening on an outside from an entrance of the external auditory canal, the user rotates the shaft to the first position where an upper part of the shaft is directed towards the acoustical opening, arranges the acoustic part in the cavity of the auricle between a tragus and the anti-tragus, and arranges the resilient member in the cavity of the auricle behind the anti-tragus;

wherein, when worn in any of the two positions, the user places the guide at a top clipping of the auricle between a leg curl and an upper-tragus tubercle, a place of connection of the wire and the guide on a surface of a front ligament of the auricle, and the wire from a top of the auricle.

* * * * *